US007651093B2

(12) United States Patent
Ko

(10) Patent No.: US 7,651,093 B2
(45) Date of Patent: Jan. 26, 2010

(54) STACKING MODULE OF MEDIA DISPENSER AND CONTROL METHOD THEREOF

(75) Inventor: Kyung-Ho Ko, Pyeongtaek (KR)

(73) Assignee: LG N-Sys Inc., Seoul (KR)

( * ) Notice: Subject to any disclaimer, the term of this patent is extended or adjusted under 35 U.S.C. 154(b) by 252 days.

(21) Appl. No.: 11/166,150

(22) Filed: Jun. 27, 2005

(65) Prior Publication Data

US 2006/0012115 A1 Jan. 19, 2006

(30) Foreign Application Priority Data

Jul. 16, 2004 (KR) ..... 10-2004-0055788

(51) Int. Cl.
*B65H 29/20* (2006.01)

(52) U.S. Cl. ..... 271/315; 271/298

(58) Field of Classification Search ..... 271/315, 271/187, 178, 298
See application file for complete search history.

(56) References Cited

U.S. PATENT DOCUMENTS 3,162,438 A * 12/1964 Perry, Jr. ..... 271/187
4,150,757 A * 4/1979 Laybourn et al. ..... 271/187
4,275,874 A * 6/1981 DiBlasio ..... 271/4.1
4,828,243 A * 5/1989 Ebihara ..... 271/315
4,835,947 A * 6/1989 Langen et al. ..... 53/542
5,135,115 A * 8/1992 Miller et al. ..... 209/564
5,199,697 A * 4/1993 Yamada et al. ..... 271/122
5,464,316 A * 11/1995 Kranz ..... 414/798.2
5,524,876 A * 6/1996 Porter ..... 271/178
5,775,682 A * 7/1998 Hosking et al. ..... 271/3.08
5,894,937 A * 4/1999 Schmidt ..... 209/534

(Continued)

*Primary Examiner*—Patrick H Mackey
*Assistant Examiner*—Michael C McCullough
(74) *Attorney, Agent, or Firm*—Birch, Stewart, Kolasch & Birch, LLP

(57) ABSTRACT

The present invention relates to a stacking module of a media dispenser and a control method thereof. According to the present invention, there is provided a stacking module of a media dispenser. The stacking module comprises: stacking wheels rotated by a driving source to rotate the media fed from the delivery module with the media inserted between tangent wings of outer peripheral surfaces of the stacking wheels one by one; a separation plate for separating the media from the stacking wheels and guiding the separated media; a stacking plate on which the media separated from the separation plate are erected one by one; a shuttle member rotatably installed on the stacking plate and including a push bar for pushing the media erected on the stacking plate toward the stacking wheels; and a driving plate moved by an additional driving source to selectively drive the stacking plate and the shuttle member. The stacking wheels and the driving source are provided between guide plates installed to face each other with a predetermined spacing therebetween; and the separation plate, the stacking plate, the shuttle member, and the driving plate are provided on a stacking base supported in the guide plates. In the present invention, since most of the components of the stacking module are provided on the stacking base, it is easy to repair the media dispenser. Further, since the media are collected on the stacking module and delivered to the customer at a time, it is easy for the customer to take out the media. Furthermore, since the stacking module is designed so that the one driving motor drives a plurality of the components, the number of the parts can be reduced.

8 Claims, 19 Drawing Sheets

U.S. PATENT DOCUMENTS 5,899,448 A * 5/1999 Hosking ..... 271/3.08
6,331,000 B1 * 12/2001 Beskitt et al. ..... 271/3.01
6,581,927 B2 * 6/2003 Claudio ..... 271/187
7,040,618 B2 * 5/2006 Monch ..... 271/315
2002/0180142 A1 12/2002 Sisk
2005/0242498 A1 * 11/2005 Sato ..... 271/302
2006/0012113 A1 * 1/2006 Ko ..... 271/315
2006/0012114 A1 * 1/2006 Ko ..... 271/315
2006/0151939 A1 * 7/2006 Park ..... 271/207

* cited by examiner

STACKING MODULE OF MEDIA DISPENSER AND CONTROL METHOD THEREOF

BACKGROUND OF THE INVENTION

1. Field of Invention

The present invention relates to a media dispenser, and more particularly, to a stacking module of a media dispenser which stacks and collects a number of media fed through a delivery module one by one and a control method thereof.

2. Description of the Prior Art

FIG. 1 shows the constitution of a prior art media dispenser. According to the figure, various components for feeding media are provided between two guide plates 200 spaced apart by a predetermined interval from each other. A front surface of the media dispenser corresponding to an end of the guide plates 200 is provided with a door 202 for selectively opening or closing a predetermined space formed between the guide plates 200. The door 202 is installed to the guide plates 200 to be opened or closed about a hinge. Reference numeral 204 designates a locking member for keeping the door 202 closed.

In the meantime, a reject box 206 for collecting abnormal media is mounted in the space between the guide plates 200 selectively opened and closed by the door 202. A media box 208 is mounted below a position, where the reject box 206 is mounted, in the space selectively opened and closed by the door 202. The media to be fed from the media dispenser are put in the media box 208. The reject box 206 and the media box 208 are detachably mounted with the door 202 being opened.

Then, the guide plates 200 are provided with various components for feeding the media. First, a driving motor 210 providing a driving force for feeding the media is installed at a side of the guide plates 200. In order to separate the media in the media box 208 and put out them one by one, a pickup roller 212 is installed at a position corresponding to a front end of the media box 208.

A feeding path 214 for feeding the media is formed between the guide plates 200 as indicated with an arrow. The feeding path 214 is composed of a plurality of rollers 216 and belts 218. A diverter 220 for rejecting the abnormal media to the reject box 206 is provided on the feeding path 214. In addition, a discharge part 230 is provided at an upper end of the front surface of the media dispenser, which is an end portion of the feeding path 214. Such a media dispenser is installed in a cabinet defining an external appearance thereof for use.

However, such a prior art has some problems as follows.

In addition, when a large number of the media are provided to a customer in the prior art, the media are freely dropped at a position, where the customer takes out them, and are stacked up. Thus, a large number of the media are not closely stacked and thus become large in volume, so that it is very inconvenient that the customer takes them by hand.

Furthermore, when the customer did not take out the media, there is a problem in that a reject box for receiving the rejected media should be adjacent to the position, where the customer takes out the media. It is the reason why there is no way to feed the media, which are once provided to the customer, into the media dispenser again at a time.

In addition, since a variety of components of the media dispenser are provided in the guide plates 200, there is an inconvenience in that the media dispenser should be wholly disassembled in order to repair the components therein.

SUMMARY OF THE INVENTION

Accordingly, the present invention is conceived to solve the aforementioned problems in the prior art. An object of the present invention is to provide a media dispenser by which a large number of media may be delivered to a customer at a time.

Another object of the present invention is to freely design a structure for rejecting media.

A further object of the present invention is to simplify a structure for stacking a number of media.

A still further object of the present invention is to modularize a media dispenser by installing most components for stacking a number of media onto a separate stacking base from guide plates.

According to an aspect of the present invention for achieving the objects, there is provided a stacking module of a media dispenser, comprising: stacking wheels rotated by a driving source to rotate the media fed from the delivery module with the media inserted between tangent wings of outer peripheral surfaces of the stacking wheels one by one; a separation plate for separating the media from the stacking wheels and guiding the separated media; a stacking plate on which the media separated from the separation plate are erected one by one; a shuttle member rotatably installed on the stacking plate and including a push bar for pushing the media erected on the stacking plate toward the stacking wheels; and a driving plate moved by an additional driving source to selectively drive the stacking plate and the shuttle member.

Preferably, the stacking wheels, the separation plate, the stacking plate, the shuttle member, and the driving plate are provided on a stacking base of which both ends are supported in guide plates installed to face each other with a predetermined spacing therebetween.

The stacking wheels and the driving source are provided between guide plates installed to face each other with a predetermined spacing therebetween; and the separation plate, the stacking plate, the shuttle member, and the driving plate are provided on a stacking base supported in the guide plates.

The separation plate is installed to downwardly incline to the stacking plate and to be perpendicular to a tangential direction of a rotating trace of the stacking wheels between the stacking wheels.

Preferably, both side ends of the stacking plate are supported on guide rods which are positioned on the stacking base at a predetermined height and include a restitution member for causing the stacking plate to move toward the separation plate.

The stacking plate and the driving plate are provided with interconnecting pieces at corresponding positions thereof, respectively, so that the driving plate moves together with the stacking plate when the driving plate moves a predetermined distance from its initial position.

Preferably, a lower portion of the push bar of the shuttle member is connected to a connecting shaft, the driving plate is rotatably mounted with a link shaft, and both ends of a connecting link are rotatably connected to the connecting shaft and the link shaft, respectively, so that a movement of the driving plate causes the shuttle member to rotate.

The link shaft is movably seated in elongated holes of shaft supporting pieces formed in the driving plate, the link shaft is supported by an elastic member in order to move to one ends of the elongated holes, and the link shaft moves in the elongated holes according to the number of the media provided between the shuttle member and the stacking wheels.

According to another aspect of the present invention, there is provided a method for controlling the stacking module of the media dispenser when media are stacked as many as a customer wants by using the stacking module of the media dispenser, comprising the steps of: rotating the media fed one by one with the media clamped between the tangent wings of the stacking wheels; separating the media clamped between the tangent wings by means of the separation plate and then stacking the media on the stacking plate by positioning the media between the stacking wheels and the push bar of the shuttle member; causing the shuttle member to be spaced from the media by driving the driving plate at a state where the media stacked on the stacking plate are clamped by means of a clamp assembly; rotating the shuttle member to be separated from the media by allowing the driving plate to be driven and moved by the driving source.

According to the present invention so constructed, since most of the components of the stacking module can be wholly separated from the media dispenser, it is easy to repair the media dispenser. Further, since the media are collected on the stacking module and delivered to the customer at a time, it is easy for the customer to take out the media. Furthermore, since the stacking module is designed so that the one driving motor drives a plurality of the components, the number of the parts can be reduced.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Hereinafter, a preferred embodiment of a media dispenser according to the present invention will be described in detail with reference to the accompanying drawings.

Figure 1:
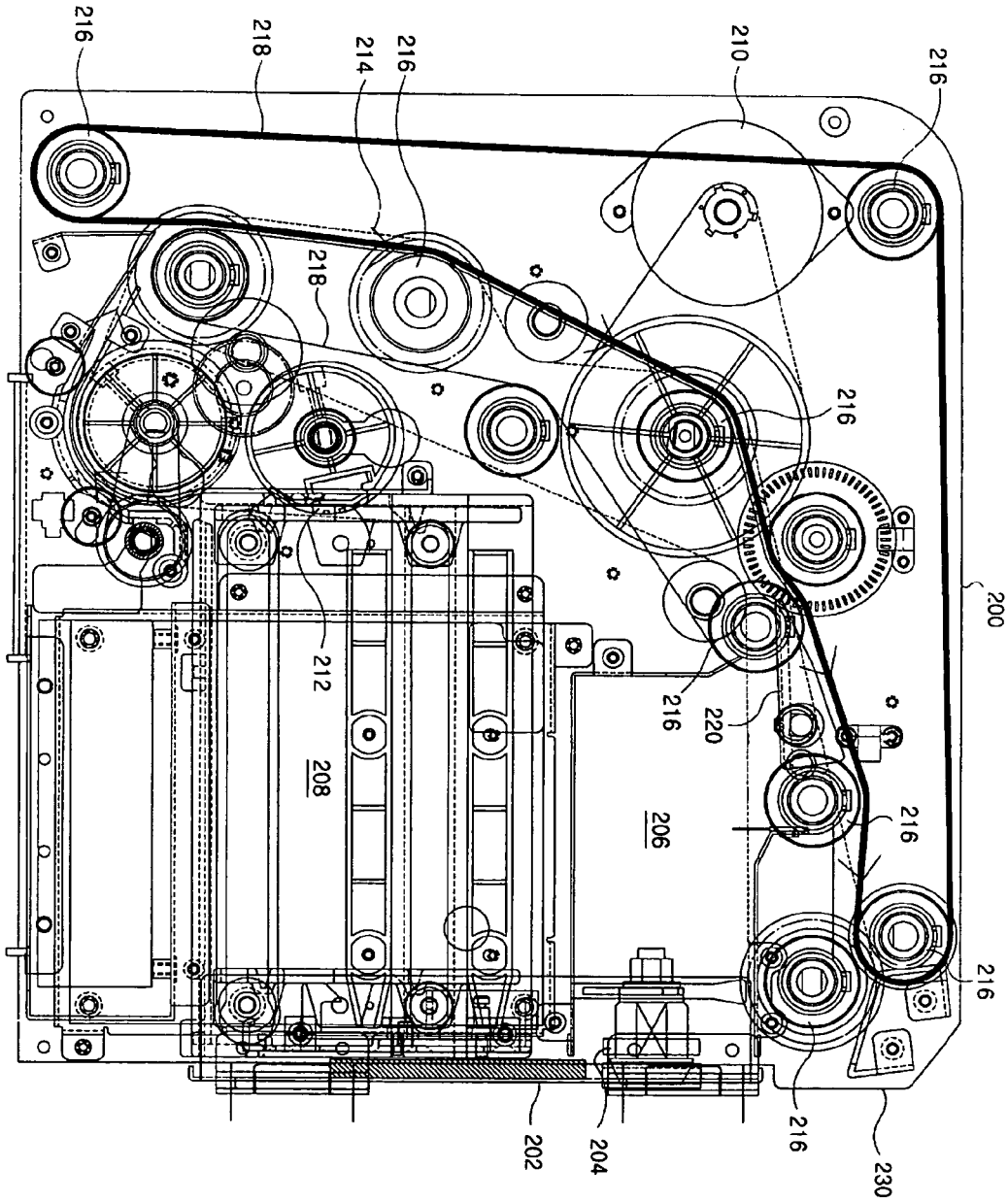
Fig. 1 Related art
FIG. 1 is a side view showing a media dispenser according to a prior art.
Figure 2:
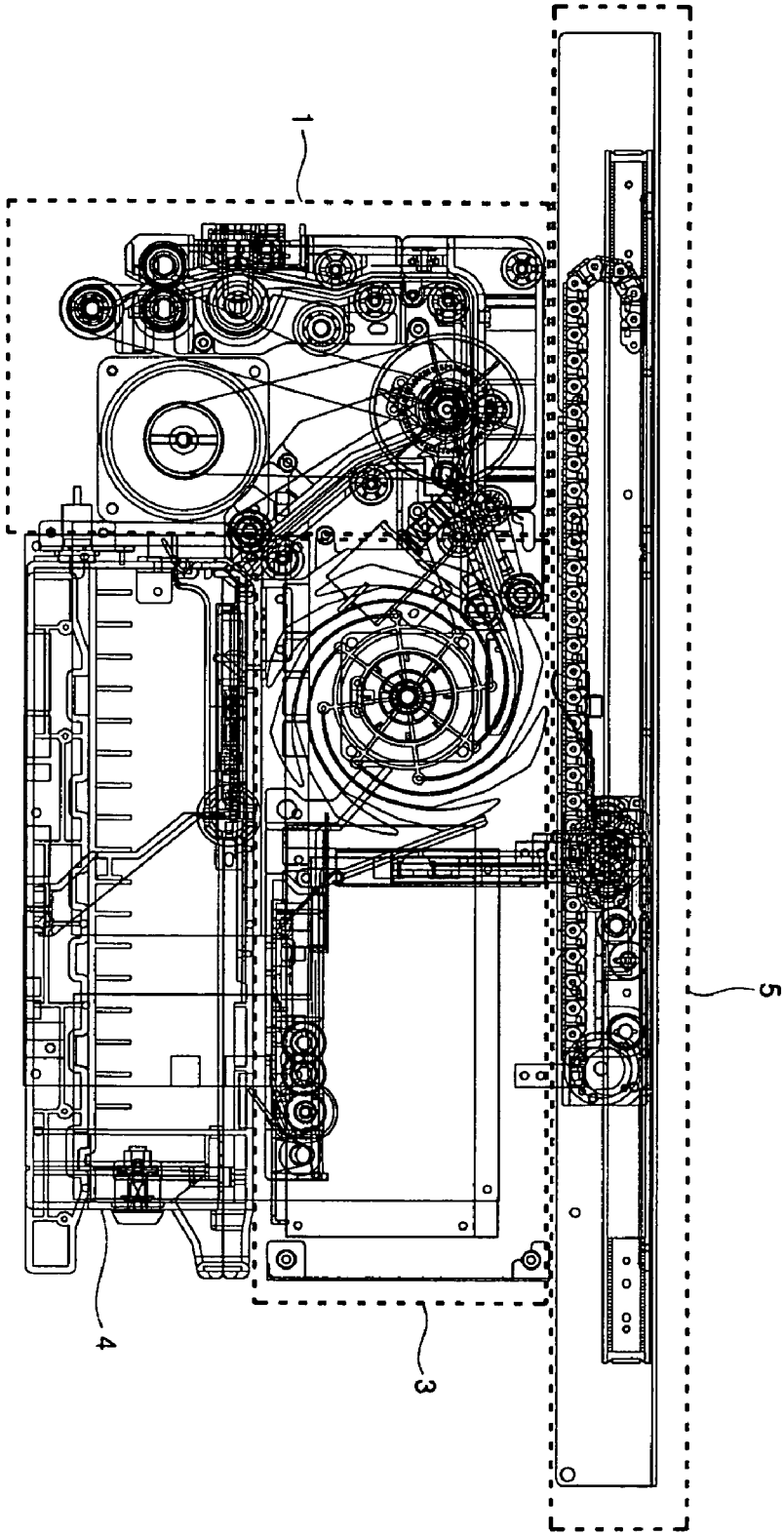
FIG. 2 is a side view showing a media dispenser where a preferred embodiment of a stacking module according to the present invention is employed.
Figure 3:
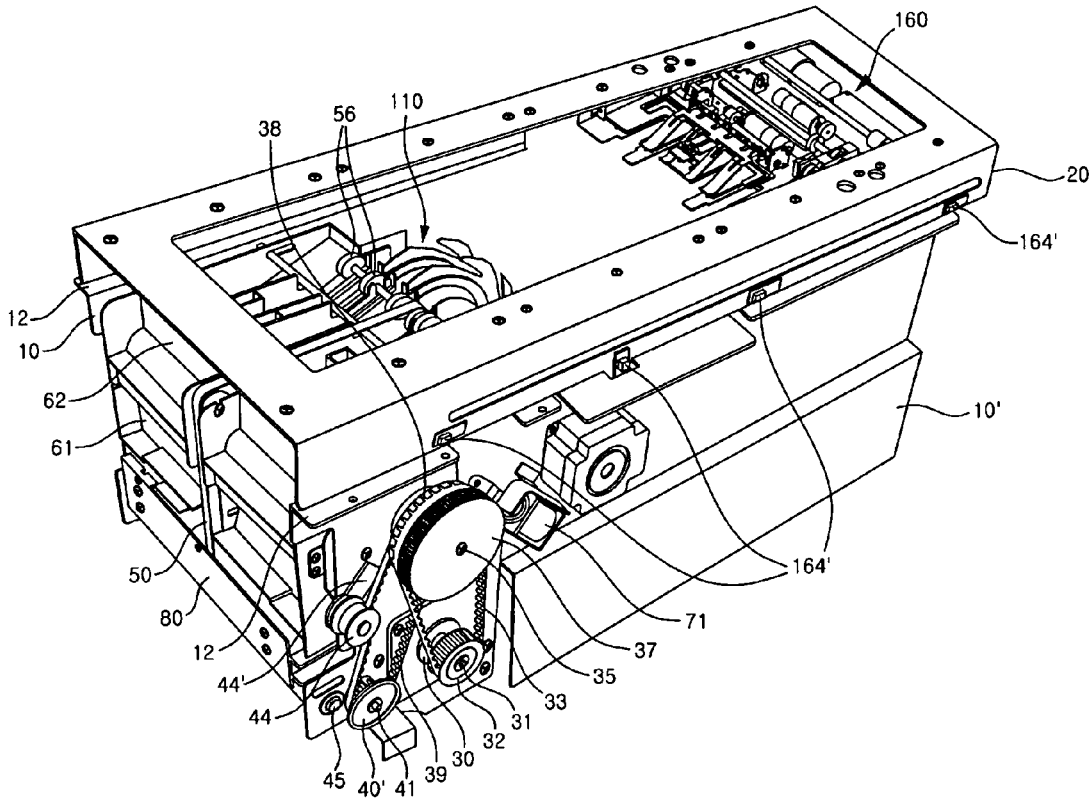
FIG. 3 is a perspective view generally showing a major portion of the media dispenser where the embodiment according to the present invention is employed.

First, FIG. 2 is a side view showing a media dispenser where a stacking module according to the present invention is employed. FIG. 3 is a schematic perspective view showing the media dispenser where the embodiment according to the present invention is employed.

Referring to the figures, a media dispenser of the embodiment according to the present invention comprises a delivery module 1, a stacking module 3, and a delivery clamp module 5. The delivery module 1 serves to separate numbers of media from a media box (not shown), in which the media are stored, one by one and feed the media fed through a feed module (not shown) to a predetermined position. While feeding the media, the delivery module 1 also serves to divide the media into ones to be rejected and the others to be discharged by sensing thickness of the media. Reference numeral 4 designates a reject box.

The stacking module 3 serves to collect desired numbers of the media fed through the delivery module 1 and then feed them to the delivery clamp module 5. The delivery clamp module 5 serves to deliver the media fed from the stacking module 3 to a position, where a customer may take out the media at a time.

Figure 4:
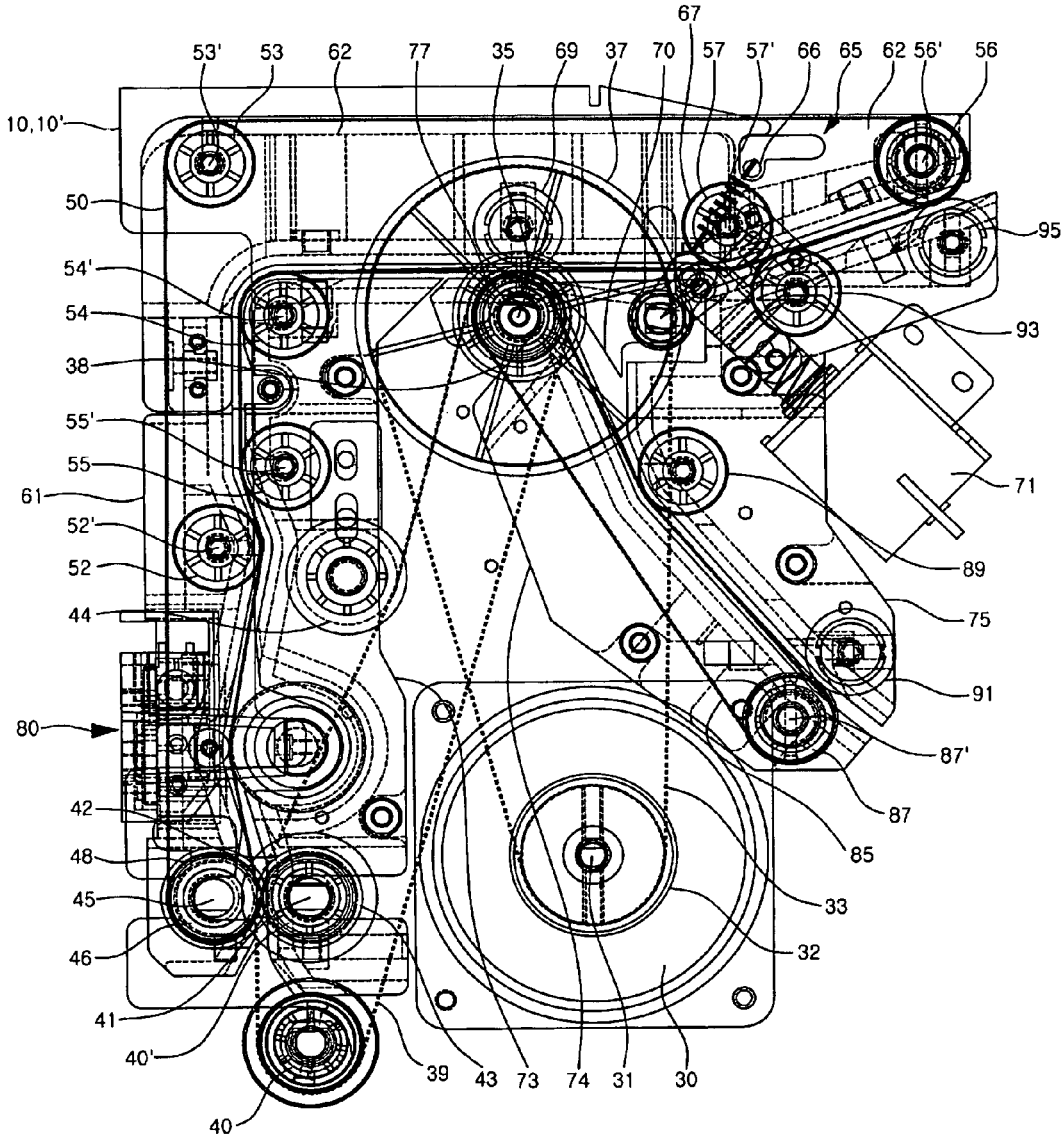
FIG. 4 is a side view showing a delivery module of the media dispenser where the embodiment according to the present invention is employed.

Referring next to FIG. 4, the delivery module 1 will be described in detail. As shown in the figure, guide plates 10 and 10' are spaced apart from each other in parallel. Each of the guide plates 10 and 10' is substantially shaped in rectangular plate. Upper ends of the respective guide plates 10 and 10' are provided with upper end flanges 12 and 12' which are bent generally outwardly to be perpendicular to the guide plates 10 and 10'. The guide plates 10 and 10' need not be configured so that each of them is a single piece.

The upper end flanges 12 and 12' of the guide plates 10 and 10' are mounted with a clamp guide 20. The clamp guide 20 is a portion that movably supports a clamp assembly 160 of the delivery clamp module 5.

The guide plate 10' is mounted with a driving motor 30. The driving motor 30 provides a driving force for feeding the media in the delivery module 1. A rotational shaft 31 of the driving motor 30 is mounted with a driving pulley 32. The driving belt 33 which is a timing belt is wound on the driving pulley 32.

The driving belt 33 is also wound on a driven pulley 37 which rotates about a rotational shaft 35 both ends of which are supported in the guide plates 10 and 10'. The driven pulley 37 is provided on the guide plate 10'. Thus, the driving force of the driving motor 30 is transferred to the driven pulley 37 through the driving belt 33. The rotational shaft 35 is provided with a connecting pulley 38 coaxially with the driven pulley 37. A connecting belt 39 which is a timing belt is wound on the connecting pulley 38 that rotates integrally with the rotational shaft 35.

In a lower portion of the guide plate 10', a first driven pulley 40 is rotatably mounted to a separate guide plate (i.e., a guide plate of the feed module provided below the delivery module 1) (see FIG. 4). For reference, although the first driven pulley 40 is not shown in FIG. 3, the connecting belt 39 is wound on a second driven pulley 40'. The guide plate 10' is provided with the second driven pulley 40' on which the connecting belt 39 wound on the first driven pulley 40 is also wound. The second driven pulley 40' is installed so as to rotate integrally with a rotational shaft 41 both ends of which are supported in the guide plates 10 and 10'. A driving gear 42 is installed on an end of the rotational shaft 41 which protrudes from an outer side surface of the guide plate 10. The driving gear 42 is rotated integrally with the second driven pulley 40' by the rotational shaft 41. On the rotational shaft 41, rollers 43 are mounted spaced apart by predetermined intervals from each other between the guide plates 10 and 10'.

A tension pulley 44 for controlling a tension of the connecting belt 39 is installed on the guide plate 10' while the tension pulley 44 is mounted in a tension bracket 44'. The tension pulley 44 may control the tension of the connecting belt 39 by adjusting the mounting position of the tension bracket 44'.

A rotational shaft 45 is installed so that both ends of the rotational shaft 45 are supported in the guide plates 10 and 10'. The rotational shaft 45 is installed in parallel with the rotational shaft 41. A driven gear 46 is installed on the rotational shaft 45 on the outer side surface of the guide plate 10 to be engaged with the driving gear 42. The driving gear 42 and the driven gear 46 may be installed on an outer side surface of the guide plate 10', so that the driving force is transferred from the rotational shaft 41 to the rotational shaft 45.

A plurality of rollers 48 are installed on the rotational shaft 45 between the guide plates 10 and 10'. The plurality of the rollers 48 includes feed rollers which are in contact with the media and transmit a driving force for feeding them and a crown roller on which a delivery belt 50 is wound. For convenient of description, reference numerals are not additionally given thereto. In the present embodiment, the rotational shaft 45 is provided with three of the rollers 48, wherein the center one is the crown roller and both the side ones are the feed rollers.

The delivery belt 50 is wound on the crown roller of the rollers 48. The delivery belt 50 which is wound on the roller 48 is in direct contact with the media and thus serves to feed them. The feed rollers among the rollers 48 on which the delivery belt 50 is not wound are installed at positions corresponding to feed rollers of the rollers 43 provided on the rotational shaft 41.

In the present embodiment where only the one delivery belt 50 is used, the delivery belt 50 is wound on rollers 52, 53, 54, 55, 56, and 57 mounted on roller shafts 52', 53', 54', 55', 56', and 57', respectively. The rollers 52, 53, 54, 55, 56, and 57 are crown rollers, and the rollers 56 include feed rollers.

First and second media guides 61 and 62 for guiding the media fed by the conveyer belt 50 are installed between the guide plates 10 and 10'. Although each of the media guides 61 and 62 is formed to consist of a single molded piece in the present embodiment, it may be formed to consist of at least two of molded pieces with a similar shape and arranged in parallel with each other. The constitution of the media guides 61 and 62 is well shown in FIG. 5. The rollers 52, 53, 54, 55, 56, and 57 are rotatably mounted in the media guides 61 and 62.

The first and second media guides 61 and 62 are separately manufactured and are integrally assembled to each other, and rotate about the rotational shaft 45 so that upper ends of the media guides are angled out of the guide plates 10 and 10'. The rotational shaft 45 is a center of the rotation of the first and second media guides 61 and 62. That is, an assembly including the first and second media guides 61 and 62 rotates about the rotational shaft 45 so as to protrude out of the guide plates 10 and 10'. The rotation of the media guides 61 and 62 about the rotational shaft 45 is intended to remove the media jammed during the feeding.

Further, a locker mechanism 65 is provided such that the first and second media guides 61 and 62 are kept mounted at a correct position during the operation of the media dispenser.

Figure 6:
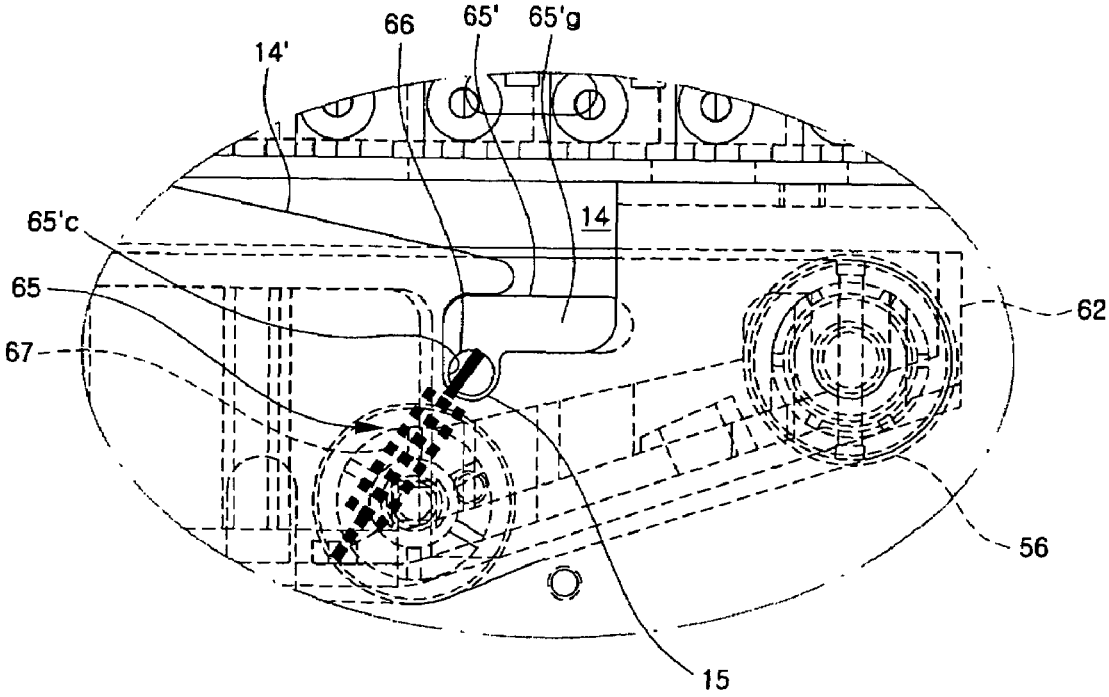
FIG. 6 is a side view showing a locker mechanism of the present invention.

Before describing the locker mechanism 65, components provided on the media guides 61 and 62 corresponding thereto will be first described with reference to FIG. 6. The guide plates 10 and 10' are formed with locking slots 14, respectively. The locking slots 14 are provided in upper ends of the guide plates 10 and 10' in which a guide step 14' is formed along a portion of a circumference of each locking slot 14. The guide steps 14' are formed to downwardly incline to an end of the guide plates 10 and 10'. A lower leading end of each guide step 14' is provided with a seating slot 15 communicating with the locking slot 14. The seating slots 15 extend by a predetermined length toward the lower portion of the guide plates 10 and 10'.

Figure 5:
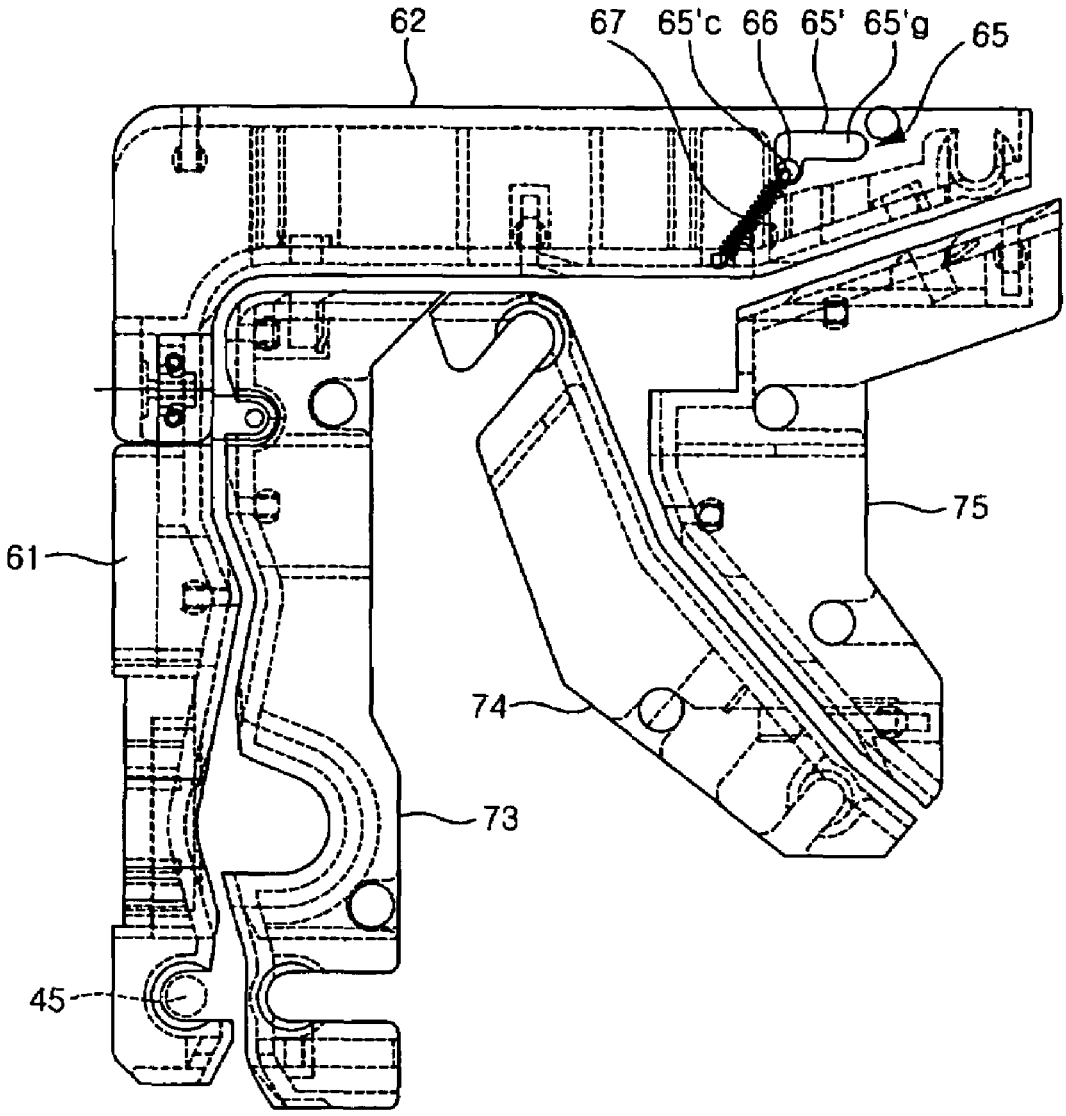
FIG. 5 is a side view showing an arrangement of media guides provided in the delivery module of the present invention.

An interconnecting slot 65' is bored through the second media guide 62 to be opened at both side ends of the second media guide 62. Here, as shown in FIG. 5, the interconnecting slot 65' is provided at positions corresponding to the locking slots 14. The interconnecting slot 65' is formed with a guide portion 65'*g* and a catching portion 65'*c* perpendicular to each other. The catching portion 65'*c* extends to the same direction as the seating slot 15.

Both ends of a locker shaft 66 are seated into the interconnecting slot 65'. The locker shaft 66 is formed with a length so that both the ends thereof can be seated into the locking slots 14. That is, the locker shaft 66 has a length so that both the ends thereof protrude from both side ends of the guide plates 10 and 10'. Both the ends of the locker shaft 66 are also supported by locker springs 67. The locker springs 67 generate an elastic force which intends the locker shaft 66 to seat on the catching portion 65'*c*.

Referring again to FIG. 4, the second media guide 62 is mounted with an idle roller 69. The idle roller 69 is provided at a position corresponding to the rotational shaft 35. A plurality of the idle rollers 69 may be installed, so that the idle rollers 69 rotate due to the movement of the media and guide the movement of the media. The idle rollers 69 may be rotatably installed separately from each other.

A diverter 70 is provided at a portion of the media feeding path after the media pass through the idle rollers 69. The diverter 70 serves to normally discharge or to reject the media. The diverter 70 is driven by a solenoid 71 provided on the outer side surface of the guide plate 10'. The diverter 70 serves to guide the media to one of two media feeding paths by turning on/off the solenoid 71.

As shown in FIG. 5, third, fourth, and fifth media guides 73, 74, and 75 are provided to correspond to the first and second media guides 61 and 62. Predetermined gaps are provided between the third, fourth, and fifth media guides 73, 74, and 75 and the first and second media guides 61 and 62, so that the media are fed through the gaps. A predetermined gap is also provided between the fourth and fifth media guides 74 and 75, and thus, defines a path for feeding the media to the reject box after the media pass therebetween.

It is preferred that each of the media guides 73, 74, and 75 be formed into a single molded piece. However, each of the media guides 73, 74, and 75 may be formed to consist of a plurality of pieces with the same shape and arranged in parallel with each other. The third, fourth, and fifth media guides 73, 74, and 75 are fastened and installed to the guide plates 10 and 10'. For example, the third, fourth, and fifth media guides 73, 74, and 75 are fastened to the guide plates 10 and 10' by means of screws which penetrate the guide plates 10 and 10'.

The predetermined gap is formed between the first and third media guides 61 and 73, and thus, the third media guide 73 guides the media to be fed. The predetermined gap is also formed between the fourth and fifth media guides 74 and 75, so that the path wherein the media are rejected through the gap is defined. The predetermined gap is also formed between the second and fifth media guides 62 and 75, so that the path through which the media are fed to the stacking module 3 is defined.

A plurality of rollers 77 are mounted on the rotational shaft 35 at positions corresponding to interior of the fourth media guide 74. The plurality of the rollers 77 are provided at positions corresponding to the idle rollers 69. Most of the rollers 77 are feed rollers which rotate due to the rotation of the rotational shaft 35 and thus feed the media. One of the rollers 77 is a crown roller on which a reject belt 85, which will be described below, is wound.

The first media guide 61 is provided with a thickness sensing unit 80 which prevents at least two sheets of media from discharging at a time by sensing a thickness of the media passing between the first and third media guides 61 and 73. Description of the thickness sensing unit 80 is omitted since it is not a feature of the present invention.

In order to reject the media through the gap between the fourth and fifth media guides 74 and 75, the reject belt 85 is provided. The reject belt 85 is wound on the crown roller among the rollers 77 provided on the rotational shaft 35 and also wound on one of rollers 87 rotatably mounted on a roller shaft 87' provided in the fourth media guide 74. The roller shaft 87' is provided with a plurality of the rollers 87 which consist of a crown roller on which the reject belt 85 is wound and feed rollers which feed the media.

The fifth media guide 75 is provided with a roller 89 which is rotated while being brought into close contact with the reject belt 85. The roller 89 is a kind of crown roller. The fifth media guide 75 is mounted with idle rollers 91 corresponding to the rollers 87. The idle rollers 91 are provided corresponding to the feed rollers among the rollers 87.

The fifth media guide 75 is mounted with a roller 93 corresponding to a roller 57 of the second media guide 62. The roller 93, which is a kind of a crown roller, is in close contact with the delivery belt 50 and feeds the media. The fifth media guide 75 is also provided with idle rollers 95 at positions corresponding to rollers 56 of the second media guide 62. The idle rollers 95 are provided at positions corresponding to the feed rollers among the rollers 56.

Figure 7A:
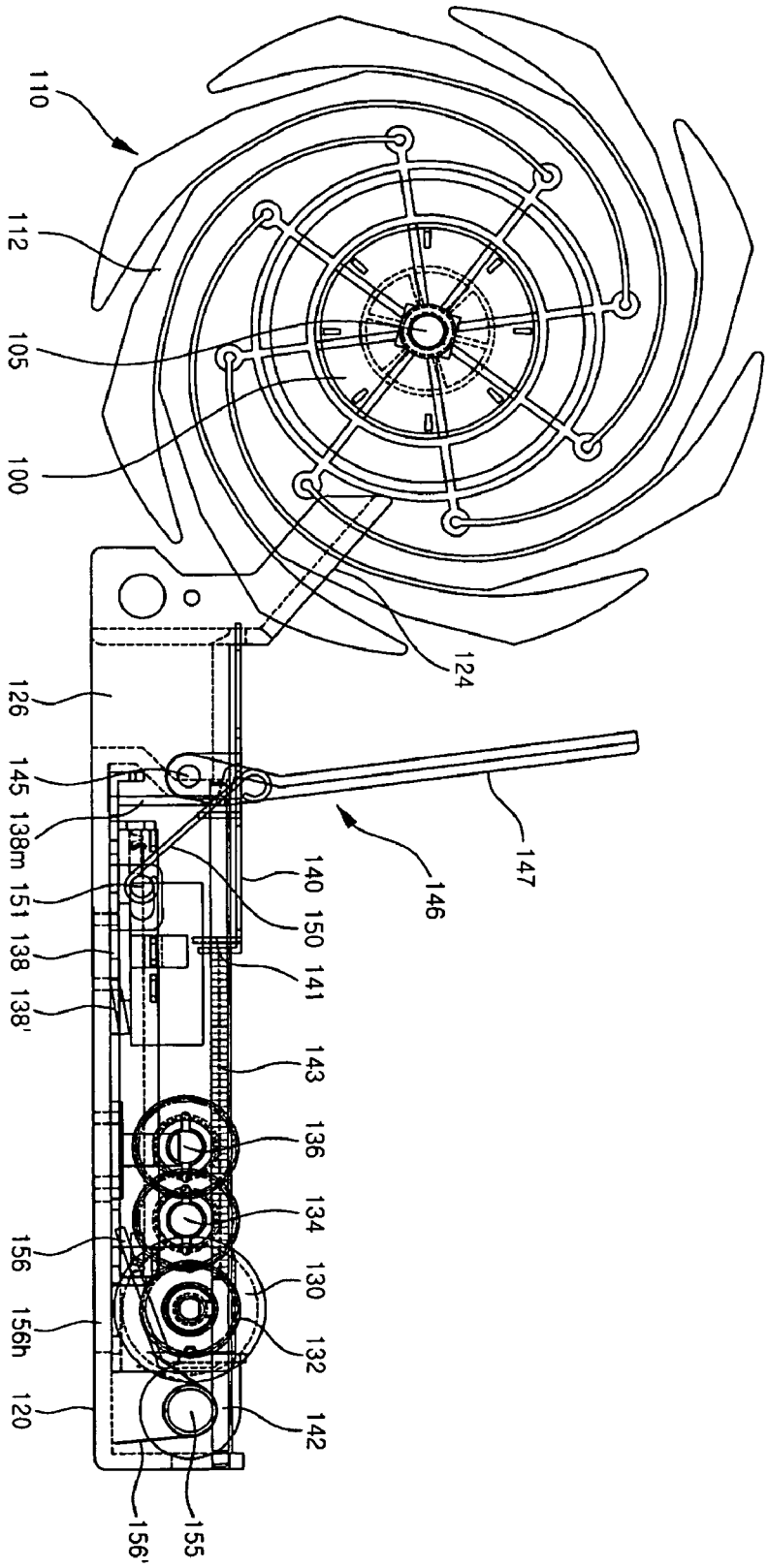
FIG. 7*a* is a side view showing the preferred embodiment of the stacking module according to the present invention.
Figure 7B:
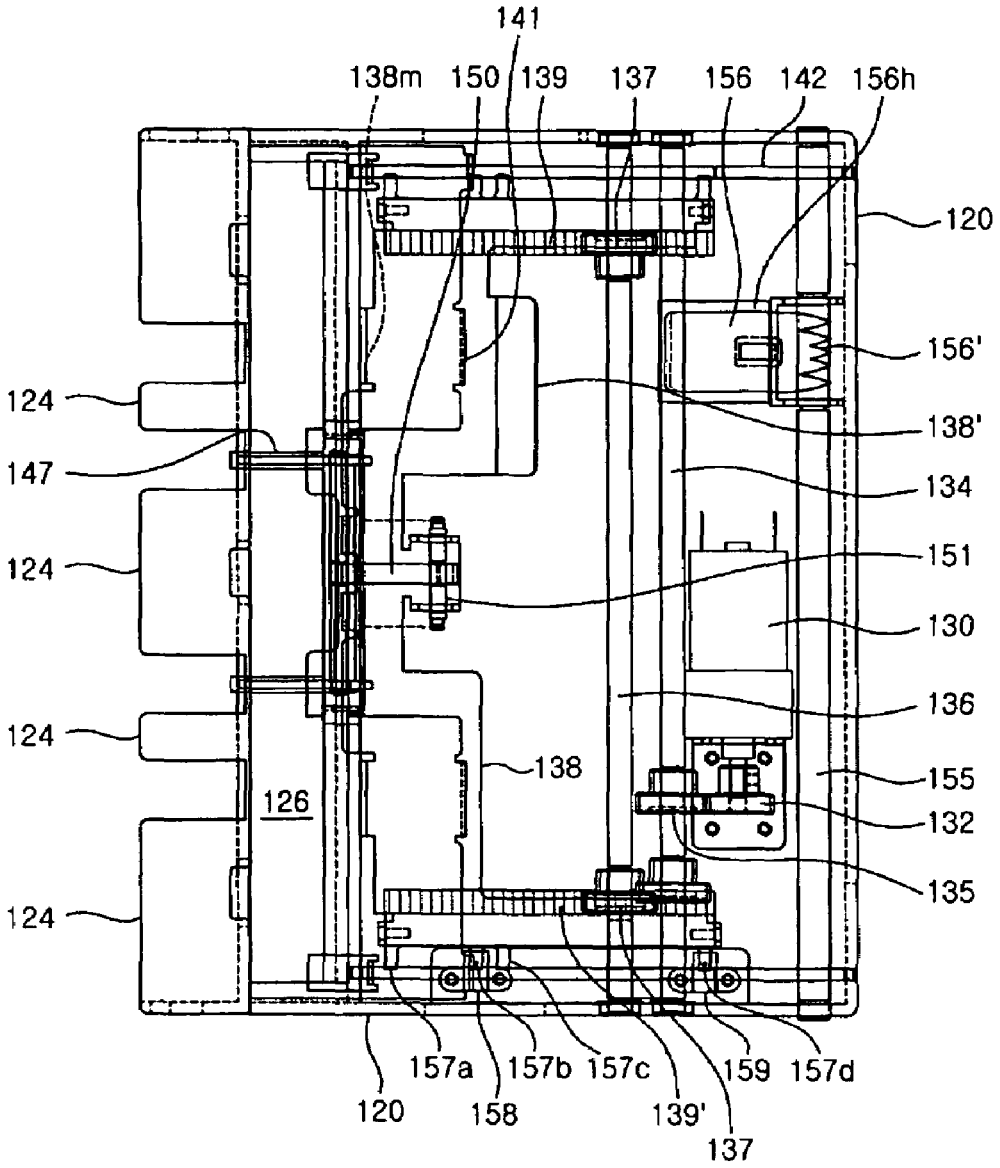
FIG. 7*b* is a plan view showing a major portion of the embodiment according to the present invention.
Figure 8:
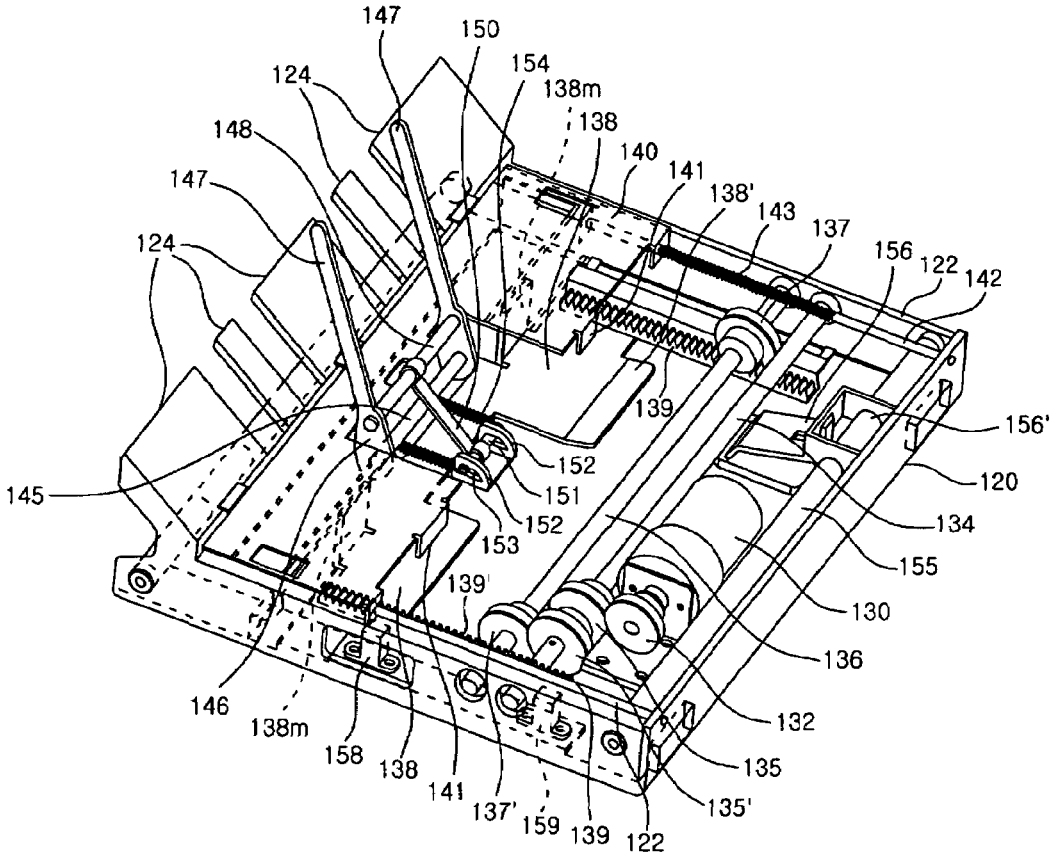
FIG. 8 is a perspective view showing the major portion of the embodiment according to the present invention.

Referring next to FIGS. 7*a*, 7*b*, and 8, the stacking module 3 will be described.

An inner side surface of the guide plate 10' is mounted with a driving motor 100. The driving motor 100 drives a wheel rotating shaft 105. One end of the wheel rotating shaft 105 is connected to the driving motor 100, and the other end of the wheel rotating shaft 105 is supported in the guide plate 10.

The wheel rotating shaft 105 is mounted with a plurality of stacking wheels 110. The plurality of the stacking wheels 110 are mounted on the wheel rotating shaft 105 at certain intervals. In the present embodiment, although two pairs, i.e., four, of the stacking wheels are employed, the number of them may be designed variously according to the width or length of the media. The stacking wheels 110 are rotated by a driving force of the driving motor 100.

The stacking wheels 110 are provided with a plurality of tangent wings 112 so as to extend in the tangential direction along outer circumference surface of the stacking wheels 110. The media are inserted between the outer circumference surfaces of the stacking wheels 110 and the tangent wings 112 one by one, and then, fed to a stacking plate 140, which will be described below, by means of the rotation of the stacking wheels 110.

A stacking base 120 is mounted to the guide plates 10 and 10' by fixing both side ends of the stacking base 120 to the guide plates 10 and 10'. A front end of the stacking base 120 is positioned adjacent to the stacking wheels 110. The stacking base 120 is substantially shaped in a rectangular plate with a width corresponding to a width between the guide plates 10 and 10'. Both the side ends of the stacking base 120 are formed with side walls 122 to extend, respectively. Such a stacking base 120 is provided with a structure for stacking the media.

First, separation plates 124 are provided to be positioned between the stacking wheels 110. The separation plates 124 are provided at the front end of the stacking base 120. However, the separation plates 124 are not always provided at the front end of the stacking base 120. The separation plates 124 serve to separate the media which are inserted between the tangent wings 112 of the stacking wheels 110 and fed. The separation plates 124 are provided to incline between the stacking wheels 110. The separation plates 124 incline about perpendicularly to the tangential direction of a rotating trace of the stacking wheels 110. Particularly, the separation plates 124 downwardly incline to the stacking plate 140, which will be described below.

The stacking base 120 is formed with a reject slot 126. The reject slot 126, which is bored through the stacking base 120 upward and downward, is a portion communicating with an inlet of the reject box 4, that is, a portion wherein the media which were not delivered to the customer and are returned are fed to the reject box. The reject slot 126 is formed adjacent to proximal end portions of the separation plates 124.

A rear end of an upper surface of the stacking base 120 is provided with a driving motor 130. An output shaft of the driving motor 130 is provided with a motor gear 132. A driving force of the driving motor 130 is transferred to the motor gear 132 through a transmission. A connecting gear shaft 134 is provided so that both ends thereof are supported in the side walls 122. The connecting gear shaft 134 is mounted with two connecting gears 135 and 135'. The respective connecting gears 135 and 135' rotate integrally with the connecting gear shaft 134. The connecting gears 135 and 135' are engaged with the motor gear 132 and a driving gear 137', which will be described below, respectively.

A driving shaft 136 is installed so that both ends thereof are supported in the side walls 122. The driving shaft 136 is installed in parallel with the connecting gear shaft 134. The driving shaft 136 is provided with driving gears 137 and 137'. The driving gear 137' consists of a larger gear portion and a smaller gear portion, wherein the smaller gear portion is engaged with the connecting gear 135'.

The upper surface of the stacking base 120 is provided with a driving plate 138. The driving plate 138, which is shaped in a plate with a predetermined area, moves on the stacking base 120. The driving plate 138 is provided with a front end inclined portion 138' which upwardly inclines in the direction of the driving shaft 136. The front end inclined portion 138' serves to drive a locker 156, which will be described below.

The driving plate 138 is provided with racks 139 and 139'. The racks 139 and 139' extend along both side ends of the driving plate 138 toward the driving gears 137 and 137', respectively. Gear portions of the racks 139 and 139' are engaged with the driving gears 137 and 137', so that the racks 139 and 139' receive the driving force of the driving motor 130.

Both the side ends of the driving plate 138 are provided with interconnecting pieces 138*m* so that the driving plate 138 is interconnected with the stacking plate 140 with a time lag. The interconnecting pieces 138*m* vertically protrude upward from the driving plate 138.

The stacking base 120 is provided with the stacking plate 140. The stacking plate 140 is provided at a portion which is spaced apart by a predetermined height from the upper surface of the stacking base 120. The stacking plate 140 is positioned above the reject slot 126 at an initial position of the stacking plate 140.

The stacking plate 140 is provided with interconnecting pieces 141. The interconnecting pieces 141 are selectively caught to the interconnecting pieces 138*m* of the driving plate 138 and thus cause the stacking plate 140 to be moved by the driving force of the driving motor 130. To this end, the interconnecting pieces 141 are formed to be vertically bent downward from the stacking plate 140. For reference, if the stacking plate 140 moves due to the interconnection of the interconnecting pieces 141 and 138*m*, the reject slot 126 is opened. Therefore, it is possible to feed the media to the reject box 4.

The stacking plate 140 is movably supported on guide rods 142 installed along both the side ends of the stacking base 120. The guide rods 142 are installed at a height where the driving plate 138 is not hindered from moving on the stacking base 120. The guide rods 142 penetrate and movably support the stacking plate 140. The guide rods 142 are provided with restitution members 143, respectively. The restitution member 143 is a coil spring, one end of which is caught to a step formed on the guide rod 142 itself and the other end of which is supported on the stacking plate 140. Here, the restitution members 143 generate an elastic force in the direction where the stacking plate 140 returns to its initial position.

The center of the stacking plate 140 is provided with a bar shaft 145. Both ends of the bar shaft 145 are supported in the stacking plate 140. To this end, the corresponding portions of the stacking plate 140 in which both the ends of the bar shaft 145 are supported are downwardly bent, and the bar shaft 145 penetrates the corresponding portions in order to be installed.

The bar shaft 145 is provided with shuttle members 146. A push bar 147 is formed at an end of each shuttle member 146 to extend in the perpendicular direction to the bar shaft 145. The push bars 147 serve to push the media, which are fed by the stacking wheels 110 and erected on the stacking plate 140, in the direction of the stacking wheels 110. As described above, since the push bars 147 push the media, a plurality of sheets of the media are erected on the stacking plate 140 evenly. The push bars 147 are connected to each other through a connecting shaft 148. The connecting shaft 148 is connected to lower portions of the push bars 147, and causes the push bars 147 to be rotated about the bar shaft 145 by a pull operation of a link shaft 151, which will be described below.

In the meantime, a connecting link 150 is provided so that the push bars 147 interconnect with the driving plate 138. Both ends of the connecting link 150 are connected to the connecting shaft 148 and the link shaft 151 mounted to the driving plate 138, respectively.

Both ends of the link shaft 151 are supported in shaft supporting pieces 152 provided on the driving plate 138, respectively. The shaft supporting pieces 152 may be formed integrally with the driving plate 138, or mounted thereto after manufactured separately. The shaft supporting pieces 152, which are spaced apart by a predetermined interval from each other so as to support both the ends of the link shaft 151, are provided with elongated holes 153 through which the link shaft 151 passes. The link shaft 151 is seated in the elongated holes 153 in order for the shuttle members 146 including the push bars 147 to be backward retracted and push the media uniformly when a large number of the media are stacked between the push bars 147 and the stacking wheels 110.

Elastic members 154 are connected to both the ends of the link shaft 151 at one ends thereof, respectively. The other ends of the elastic members 154 are connected to the driving plate 138. Thus, the elastic members 154 elastically support the link shaft 151, and make it possible for the push bars 147 to elastically push the media.

The stacking base 120 is provided with a locker shaft 155. The locker shaft 155 is installed at an opposite position to the stacking plate 140. Although both ends of the locker shaft 155 are supported in the side walls 122, it is not necessarily so. The locker shaft 155 is provided with the locker 156.

The locker 156 is caught into a portion of the reject box provided below the stacking base 120, and thus, causes the reject box not to be detached from the media dispenser inadvertently. In particular, the locker 156 serves to fasten the reject box so that the reject box is not removed out of the media dispenser while its inlet is opened. To this end, the stacking base 120 is formed with a through hole 156*h* at a position corresponding to the locker 156. The locker 156 is supported by a spring 156' in order not to protrude below the stacking base 120 at a normal state.

In the meantime, as shown in FIG. 7*b*, the driving plate 138 is formed with first, second, third, and fourth protruding sensing pieces 157 (157*a*, 157*b*, 157*c*, and 157*d*). Clamp and dump sensors 158 and 159 are provided on the stacking base 120 corresponding to a movement trace of the sensing pieces 157. The clamp and dump sensors 158 and 159 sense positions of the sensing pieces 157 and control the driving motor 130. For reference, as the clamp and dump sensors 158 and 159 sense the second and fourth sensing pieces 157*b* and 157*d*, respectively, it is recognized that the driving plate 138 is in its initial position. If the first sensing piece 157*a* is sensed by the clamp sensor 158, it is recognized that the driving plate 138 is in a clamping position. In addition, if the third sensing piece 157*c* is sensed by the dump sensor 159, it is recognized that the driving plate 138 is in a dumping position where the reject slot 126 is opened.

Figure 9:
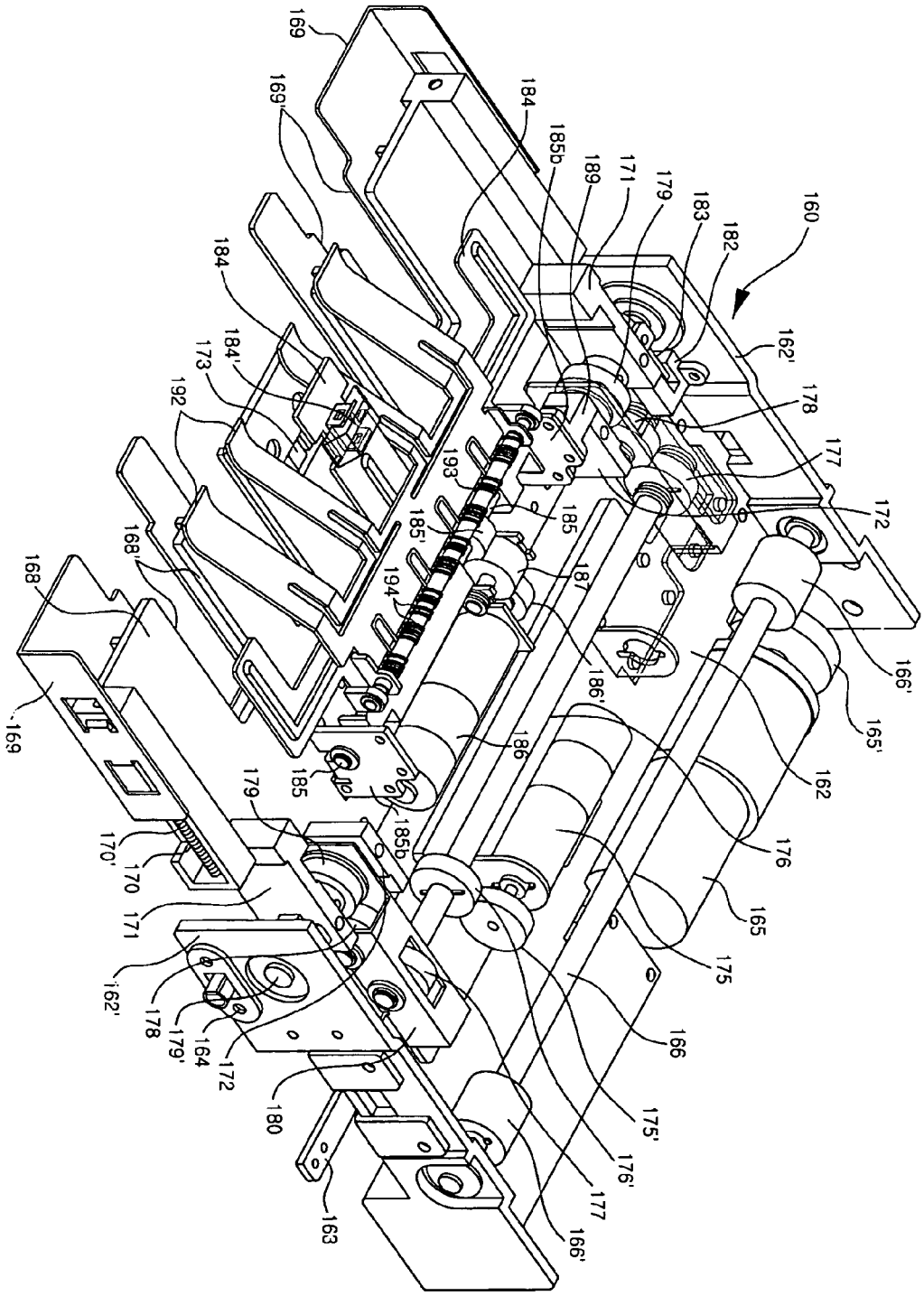
FIG. 9 is a perspective view showing a major portion of a clamp assembly of the present invention.
Figure 10:
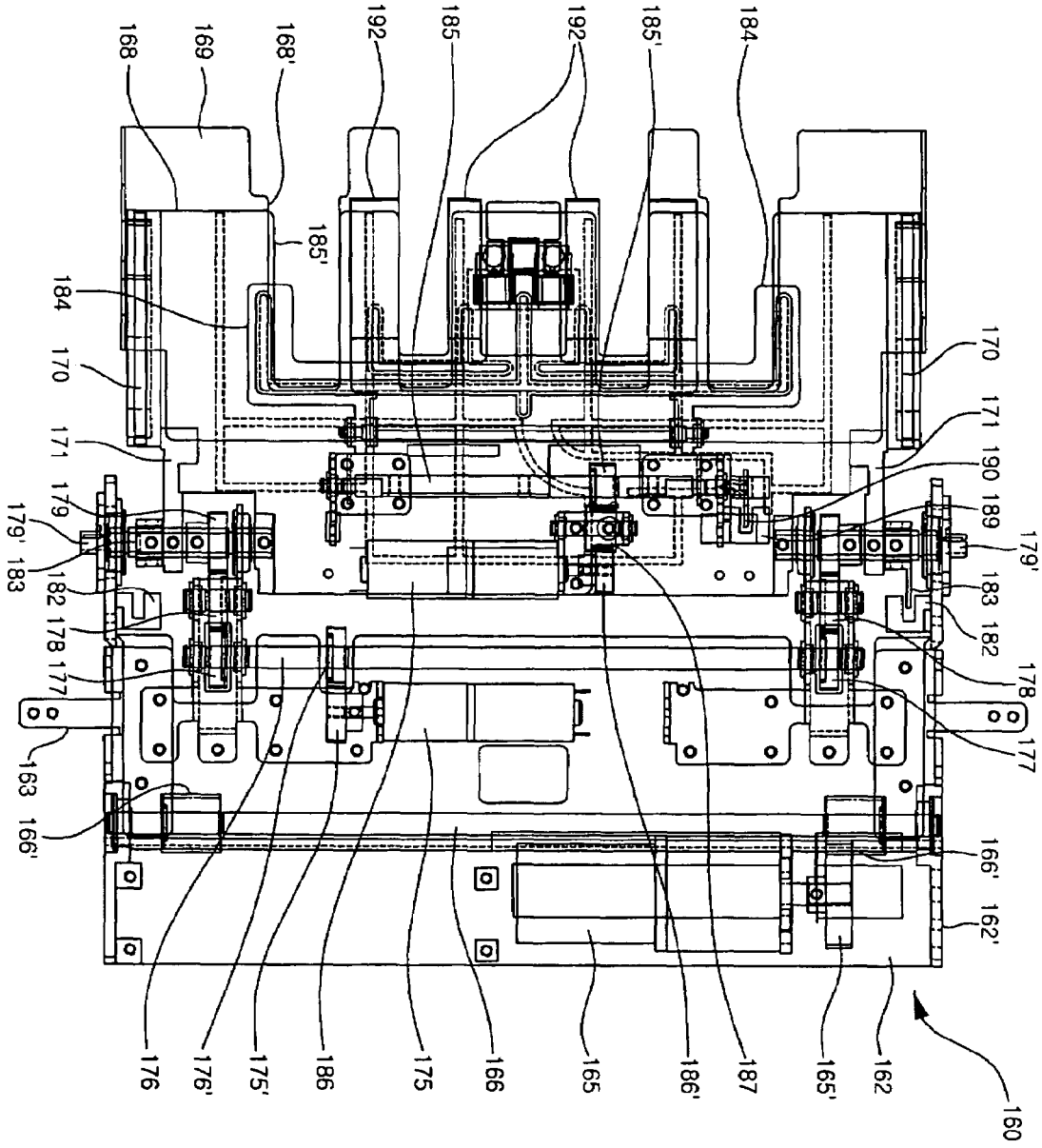
FIG. 10 is a plan view showing the major portion of the clamp assembly of the present invention.

Referring next to FIGS. 9 and 10, the delivery clamp module 5 will be described. The delivery clamp module 5 is configured so that the clamp assembly 160 is movably installed in the clamp guide 20.

The clamp assembly 160 is provided with a delivery tray 162. Both side ends of the delivery tray 162 are provided with side walls 162' which protrude by a predetermined height. The delivery tray 162 is movably supported in the clamp guide 20. To this end, both the side ends of the delivery tray 162 are provided with connecting brackets 163, respectively. The connecting brackets 163 are fastened to inner members of slide rails (not shown) provided in the clamp guide 20. When assembling them, the connecting brackets 163 are first mounted to the inner members, and then, the delivery tray 162 is fastened to the connecting brackets 163.

Each of both outer side surfaces of the side walls 162' of the delivery tray 162 is provided with a magnet mounting member 164. The magnet mounting member 164 is provided with a magnet for sensing a position of the delivery tray 162 by cooperating with a plurality of magnetic field sensors 164' provided on the clamp guide 20 (see FIG. 3).

A tray delivery motor 165 provides a driving force for moving the delivery tray 162. The tray delivery motor 165 is installed on the delivery tray 162. An output shaft of the tray delivery motor 165 is provided with a motor gear 165', which is engaged with one of rack interconnecting gears 166' coaxially installed to a delivery driving shaft 166 to transfer the driving force. The delivery driving shaft 166, both ends of which are rotatably supported in the side walls 162', are provided with the rack interconnecting gears 166' adjacent to the respective side walls 162'. The rack interconnecting gears 166' are engaged with racks (not shown) provided in the clamp guide 20 and thus cause the delivery tray 162 to linearly reciprocate with respect to the clamp guide 20.

The delivery tray 162 is mounted with a clamp base 168. The clamp base 168, which supports a side surface of a bundle of the stacked media, is rotatably mounted in the delivery tray 162. The clamp base 168 is formed with a plurality of interference preventing slots 168' so that the clamp base 168 is prevented from interfering with the stacking wheels 110 when rotating. The plurality of the interference preventing slots 168' are arranged side by side to be opened to a front end of the clamp base 168.

The clamp base 168 is provided with an extension clamp 169. The extension clamp 169 forward protrudes a little more than the clamp base 168. The extension clamp 169 is also provided with interference preventing slots 169' in the same manner as in the clamp base 168. The extension clamp 169 can move back and forth along guide shafts 170, which are provided in both side ends of the clamp base 168, respectively. Each guide shaft 170 is provided with an elastic member 170' for pushing the extension clamp 169 to the front end of the clamp base 168. The elastic member 170', both ends of which are supported by the extension clamp 169 and the clamp base 168, respectively, is a coil spring surrounding an outer peripheral surface of the guide shaft 170. The extension clamp 169 is designed so that the guide shafts 170 penetrate portions of extension clamp 169 supporting the elastic members 170', and thus, is subjected to an elastic force of the elastic members 170'.

Both rear side ends of the clamp base 168 are provided with connecting arms 171, respectively. The connecting arms 171 are formed to stand perpendicular to a surface of the clamp base 168, and thus, face the side walls 162'. A supporting piece 172 is provided on the clamp base 168 to face each of the connecting arms 171 with a predetermined spacing therebetween.

The clamp base 168 is provided with a media sensor 173 for sensing the clamped media. The media sensor 173 senses whether the media are clamped, whether the media are delivered to the customer, or the like. A media sensor 173 cooperates with a reflecting member 184' provided on a clamp arm 184, which will be described below, and thus, performs the sensing operation.

A base rotating motor 175 for driving the clamp base 168 is provided on the delivery tray 162. The driving force of the base rotating motor 175 is transferred through a plurality of gears. That is, an output shaft of the base rotating motor 175 is provided with a motor gear 175', and a driving shaft 176 installed on the delivery tray 162 is provided with a first shaft gear 176' engaged with the motor gear 175'. Both ends of the driving shaft 176 are also provided with second shaft gears 177, respectively. The second shaft gears 177 are engaged with connecting gears 178 installed on the delivery tray 162, respectively. The connecting gears 178 are engaged with rotation gears 179 provided on the connecting arms 171 of the clamp base 168.

Here, the second shaft gear 177 and the connecting gear 178 are rotatably supported in each gear bracket 180. The gear brackets 180 are installed on the delivery tray 162. A side of the gear bracket 180 extends to be positioned between the connecting arm 171 and the supporting piece 172. Then, the other side of the gear bracket 180 also serves to support the output shaft of the base rotating motor 175. Such a gear bracket 180 is provided at each of both the side ends of the delivery tray 162.

The rotation gear 179 is integrally installed on a gear shaft 179', which operates integrally with the connecting arm 171 and the supporting piece 172. That is, the connecting arms 171, the supporting pieces 172, the gear shafts 179', and the rotation gears 179 integrally rotate. However, the gear shafts 179' may rotate with respect to the gear brackets 180 and the side walls 162' of the delivery tray 162.

A configuration for controlling the rotation of the clamp base 168 will be described. Clamp sensors 182 are provided on the delivery tray 162 adjacent to the respective connecting arms 171. A sensing piece 183 is provided on each of the gear shafts 179' to be selectively positioned between light emitting and light receiving portions of the clamp sensor 182. Here, while both the clamp sensors 182 are installed on the delivery tray 162 in the same direction, the sensing pieces 183 extend in the different directions from each other by 90 degrees. Since the clamp base 168 normally and reversely rotates only within an angular range of 90 degrees, positions of the clamp base 168 are alternately sensed by both the clamp sensors 182.

The clamp arm 184 is rotatably mounted on the clamp base 168. That is, both ends of an arm rotational shaft 185 which is mounted to a rear end of the clamp arm 184 are rotatably supported in supporting brackets **185*b* of the clamp base 168**, respectively.

The clamp arm 184 is shaped to be prevented from interfering with the stacking wheels 110 when the clamp arm 184 rotates. That is, in the present embodiment, the clamp arm 184 branches off into three portions. The portions branched from the clamp arm 184 are formed not to overlap with the interference preventing slots 168'. The reflecting member 184' is provided on the clamp arm 184 at a position corresponding to the media sensor 173 of the clamp base 168. The reflecting member 184' serves to reflect a light from the light emitting portion to the light receiving portion of the media sensor 173. Due to the reflecting member 184', only the one media sensor 173 is provided on the clamp base 168.

A driving force for rotating the clamp arm 184 is generated by an arm rotating motor 186 installed on the clamp base 168. The driving force of the arm rotating motor 186 is transferred to a rotational shaft gear 185' provided on the arm rotational shaft 185 through a motor gear 186' and a connecting gear 187. Therefore, the arm rotational shaft 185 is rotated together with the clamp arm 184 by the driving force of the arm rotating motor 186.

A configuration for controlling operation of the clamp arm 184 will be described. Any one of the supporting brackets **185*b* is mounted with two arm sensors 189 spaced apart by 90 degrees with respect to the arm rotational shaft 185 from each other. The arm rotational shaft 185 is provided with a sensing piece 190 (see FIG. 10). That is, the two arm sensors 189 are provided on a movement trace of the sensing piece 190, so that the arm sensors 189 sense positions of the sensing piece 190 according to the rotation of the arm rotational shaft 185**.

The clamp arm 184 is provided with push fingers 192. Each of the push fingers 192 is shaped in a curved surface so that its front end generates a predetermined elastic force. The push fingers 192 are formed not to overlap with the interference preventing slots 168' of the clamp base 168. In the present embodiment, four of the push fingers 192 are integrally formed and provided at corresponding positions of a surface of the clamp base 168.

The push fingers 192 are supported by elastic supporting members 194 and mounted on the clamp arm 184. In the present embodiment, the elastic supporting members 194 are provided around an elastic supporting shaft 193 both ends of which are supported in the clamp arm 184. The elastic supporting members 194 rotate about the elastic supporting shaft 193, so that one ends thereof push the push fingers 192 and thus generate an elastic force. The push fingers 192 serve to press the media to the clamp base 168 regardless of the number of the media provided between the clamp base 168 and the clamp arm 184.

Hereinafter, the operation of the stacking module of the media dispenser according to the present invention so constructed will be described in detail.

By request of the customer, the media are separated from the media box one by one, pass through the feed module, and then, are fed through the delivery module 1. In the delivery module 1, the media are guided by the delivery belt 50 and fed to the stacking wheels 110. The media fed to the stacking wheels 110 are stacked on the stacking module 3 as many as the customer wants.

Referring to FIGS. 11*a* to 11*i* and 12*a* to 12*c*, it will be described that the media are stacked on the stacking module 3 as many as the customer wants and delivered to the customer.

Figure 11A:
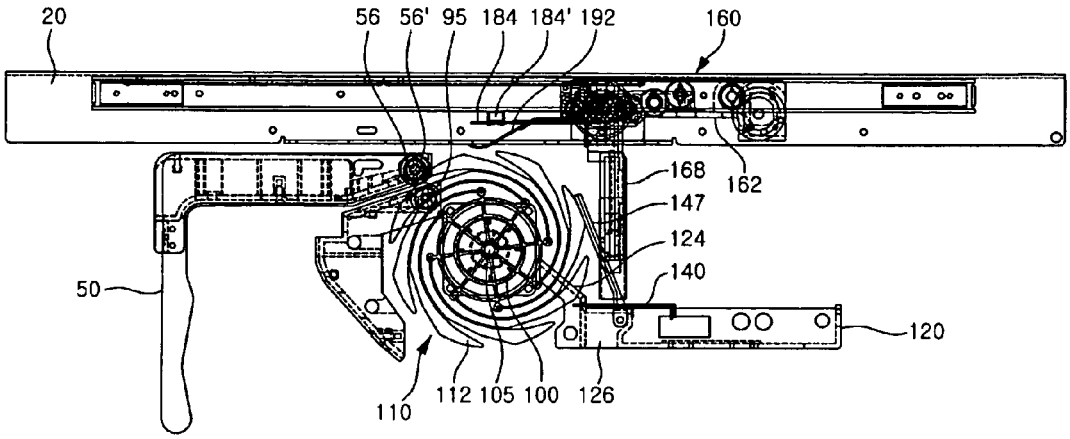
FIGS. 11*a* to 11*i* are views sequentially showing the operation of the embodiment according to the present invention.
Figure 12A:
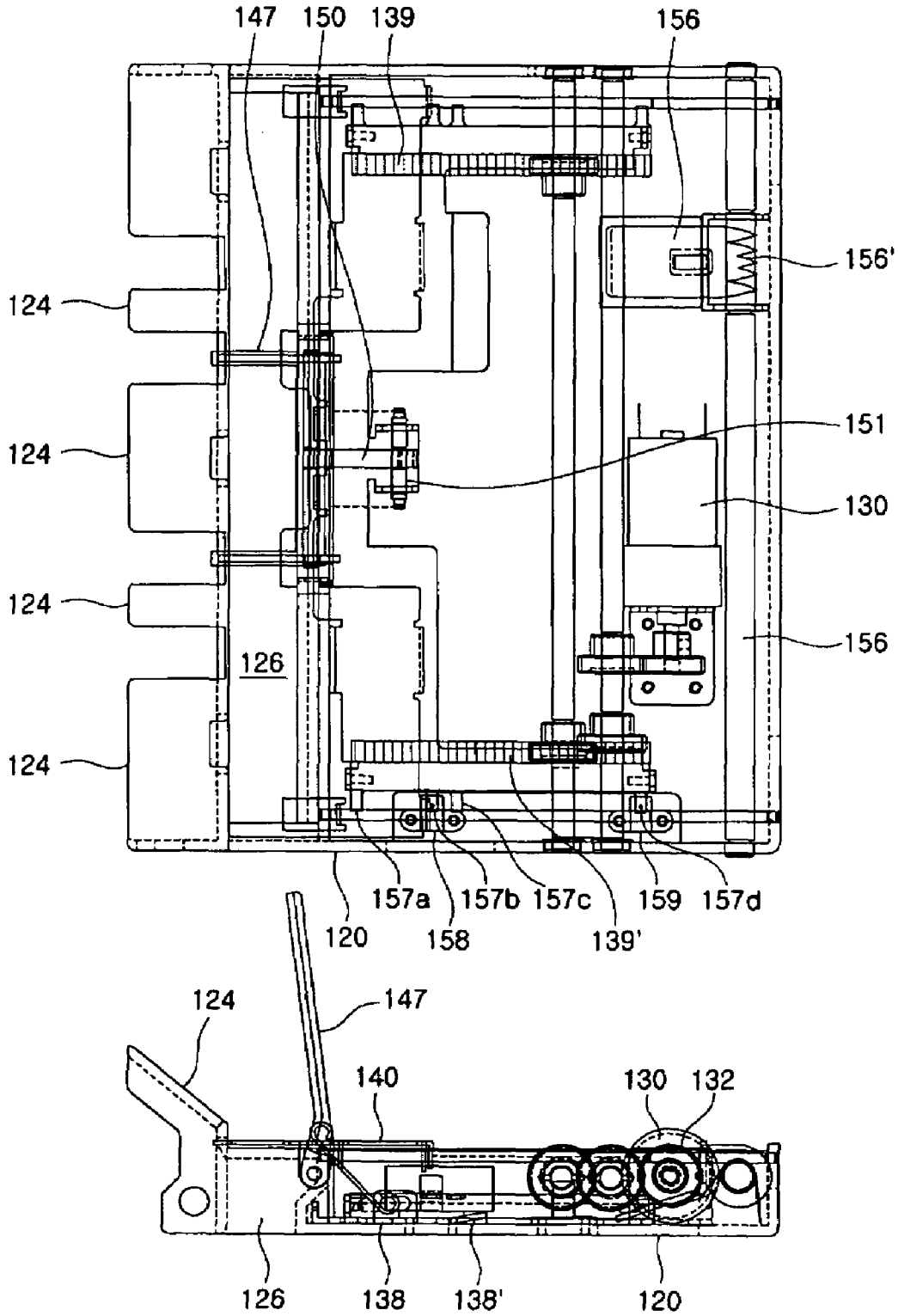
FIGS. 12*a* to 12*c* are enlarged views showing the operation of the stacking module of the embodiment according to the present invention.

First, in order to stack a number of sheets of the media on the stacking plate 140, the driving plate 138, the stacking plate 140, and the clamp assembly 160 should be positioned at their initial positions. Such a state is shown in FIGS. 11*a* and 12*a*. That is, the driving plate 138 and the stacking plate 140 move toward the separation plates 124 as close as possible. The clamp assembly 160 is positioned at a position where it is sensed by the intermediate among the magnetic field sensors 164'.

In addition, the clamp base 168 of the clamp assembly 160 hangs vertically downward. It is in a state where the sensing piece 183 at the relatively right side in FIG. 9 is sensed by the corresponding clamp sensor 182.

Furthermore, the clamp arm 184 is in parallel with the delivery tray 162. Therefore, the clamp arm 184 and the clamp base 168 are perpendicular to each other.

In such a state, the media passing between the second and fifth the media guides 62 and 75 are inserted between the tangent wings 112 of the stacking wheels 110 one by one. Then, the stacking wheels 110 are rotated by the driving motor 100, so that the media are fed by the stacking wheels 110.

If the media which have been inserted between the tangent wings 112 and rotated meet the separation plates 124, the media are separated from the stacking wheels 110. While being continuously pushed to the tangent wings 112 of the stacking wheels 110 by the push bars 147, the media separated from the stacking wheels 110 by the separation plates 124 are guided along inclined surfaces of the separation plates 124.

Figure 11B:
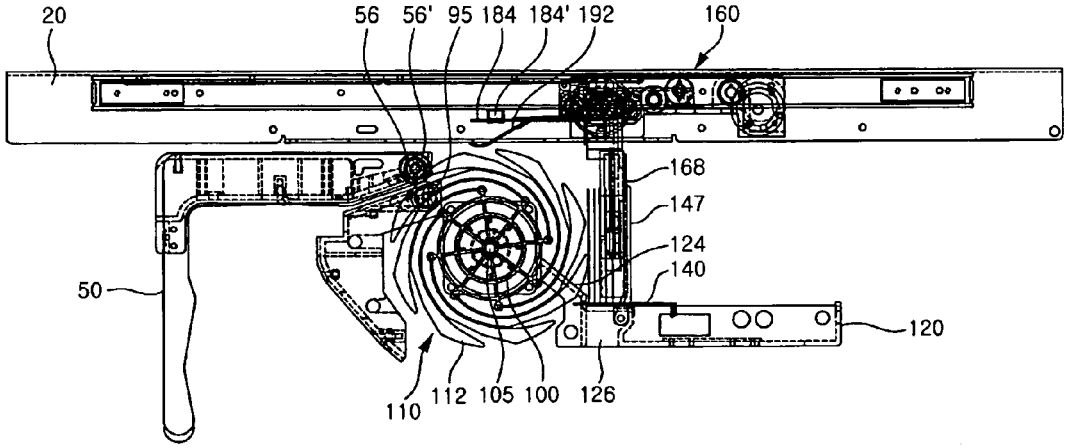

Therefore, the media are supported and erected on the stacking plate 140 between the stacking wheels 110 and the push bars 147. In such a manner, a number of sheets of the media are continuously erected on the stacking plate 140 one by one. Here, the push bars 147 push the media erected on the stacking plate 140 to be in close contact with the tangent wings 112. FIG. 11*b* shows that a number of sheets of the media are erected on the stacking plate 140.

However, if the number of the media erected between the stacking wheels 110 and the push bars 147 increases, the push bars 147 are pushed rearward. That is, while the shuttle members 146 are pushed, the connecting shaft 148, the connecting link 150, and the link shaft 151 overcomes the elastic force of the elastic members 154 and are also pushed. Therefore, the link shaft 151 moves in the elongated holes 153 according to the number of the erected media.

If a customer's desired number of the media are stacked on the stacking plate 140, the feeding of the media through the delivery module 1 is stopped. Then, the clamp arm 184 rotates. The clamp arm 184 is rotated by the driving force of the arm rotating motor 186. That is, the driving force of the arm rotating motor 186 is transferred to the arm rotational shaft 185 through the motor gear 186', the connecting gear 187, and the rotational shaft gear 185'. Since the arm rotational shaft 185 is integral with the clamp arm 184, the rotation of the arm rotating motor 186 causes the clamp arm 184 to rotate. Here, the push fingers 192 also rotate.

Figure 11C:
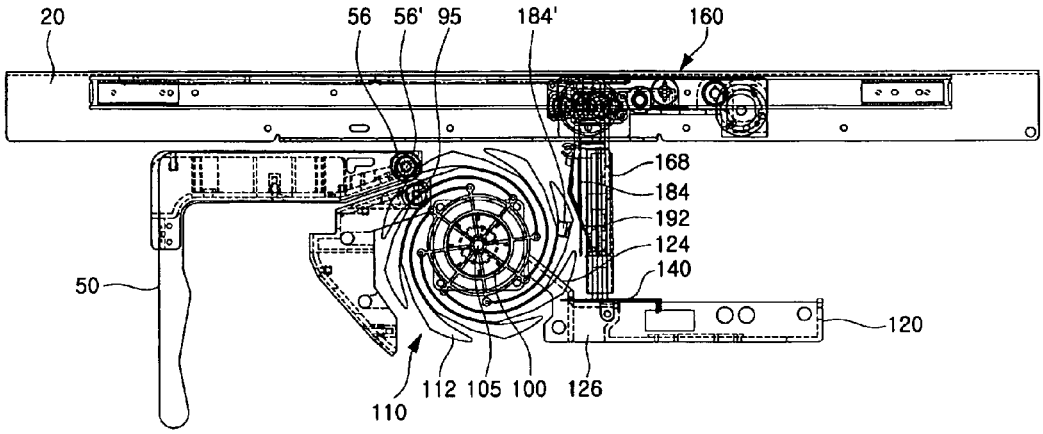

The clamp arm 184 and the push fingers 192 rotate, so that the media comes into close contact with the clamp base 168. Particularly, the push fingers 192 press the media to the clamp base 168 by means of the elastic force regardless of the number of the media. Such a state is shown in FIG. 11*c*.

Next, the shuttle members 146 rotate. The shuttle members 146 rotate due to the movement of the driving plate 138 caused from the driving force of the driving motor 130. That is, the connecting link 150 pulls the connecting shaft 148 by the movement of the driving plate 138.

Figure 11D:
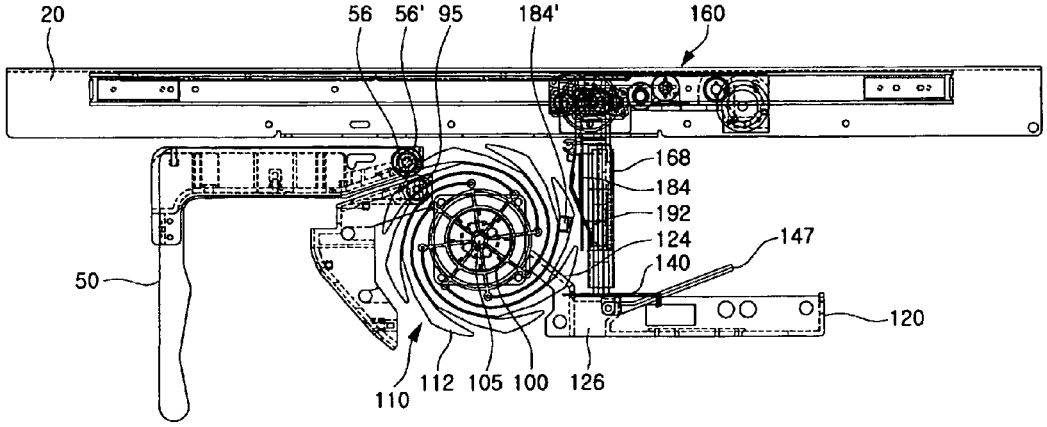
Figure 12B:
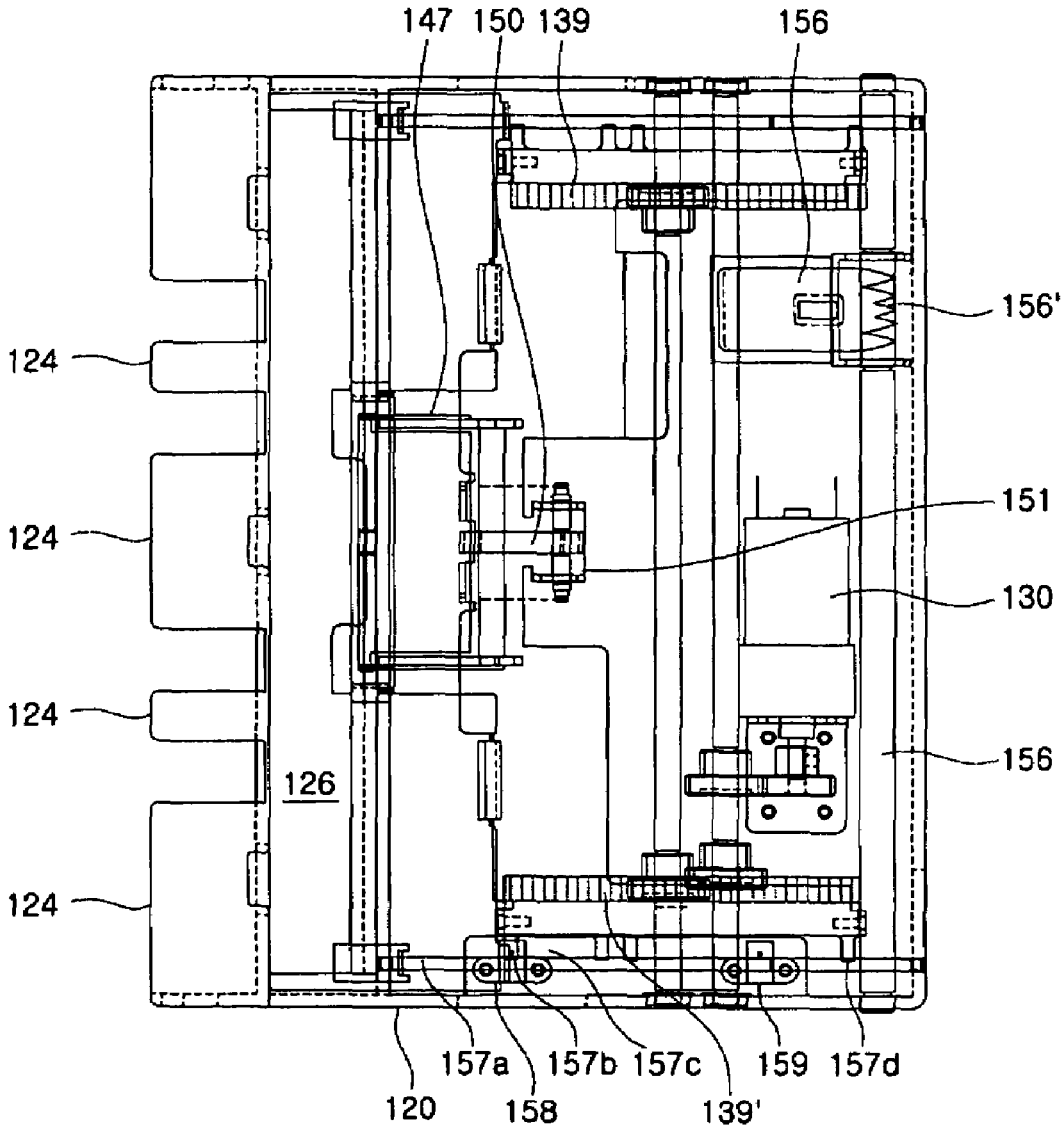
Figure 12B:
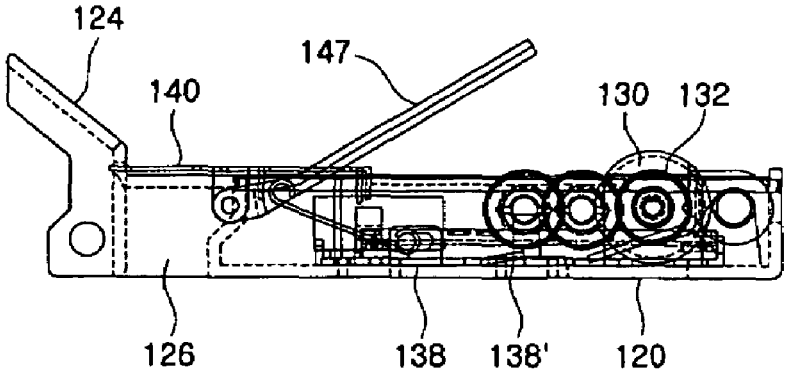

Then, the driving force of the driving motor 130 is transferred to the driving shaft 136 through the motor gear 132 and the first and second connecting gears 135 and 135'. The driving force transferred to the driving shaft 136 is transferred to the racks 139 and 139' through the driving gears 137 and 137' provided on the driving shaft 136. Therefore, the driving plate 138 provided with the rack 139 moves on the stacking base 120. The driving plate 138 moves until the first sensing piece 157*a* is sensed by the clamp sensor 158. Such a state is shown in FIGS. 11*d* and 12*b*.

Figure 11E:
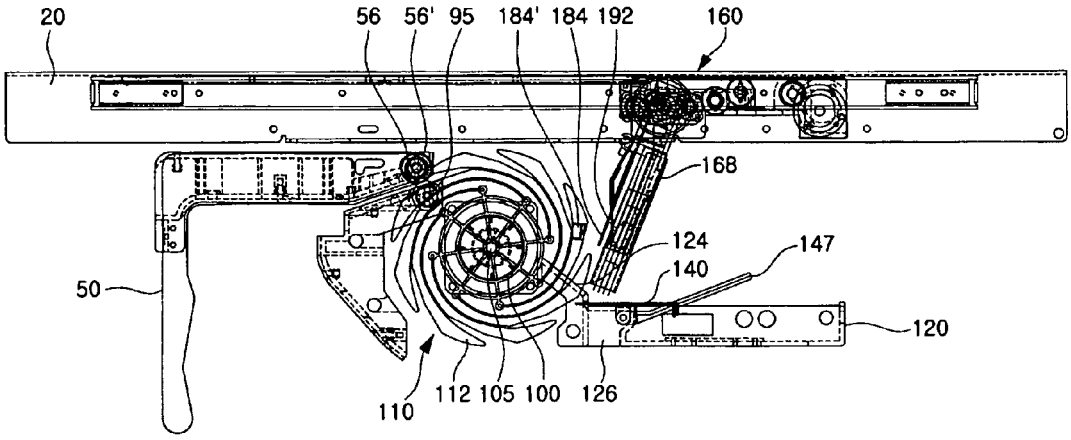
Figure 11F:
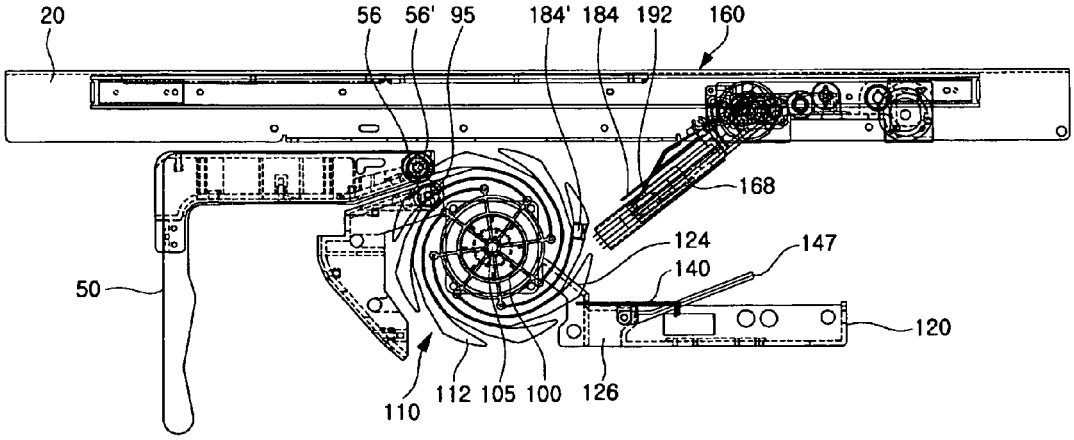
Figure 11G:
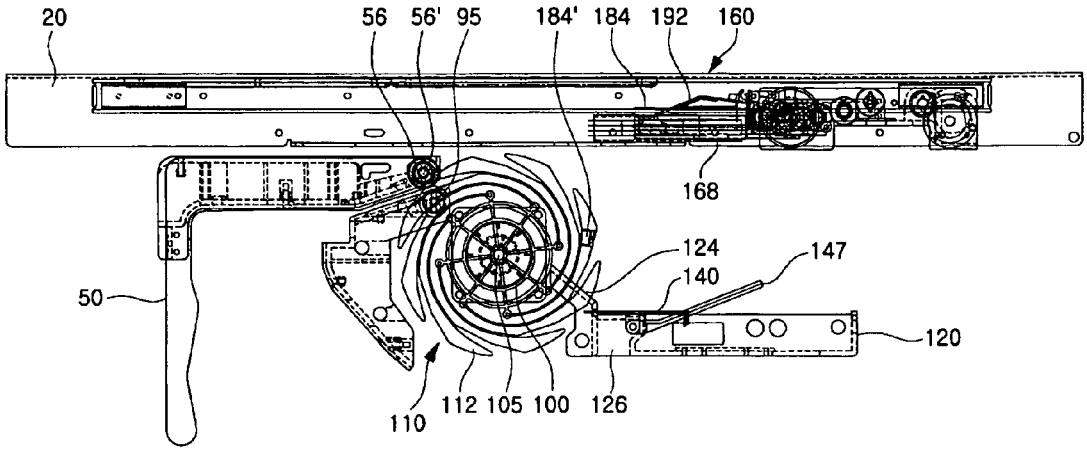
Figure 11H:
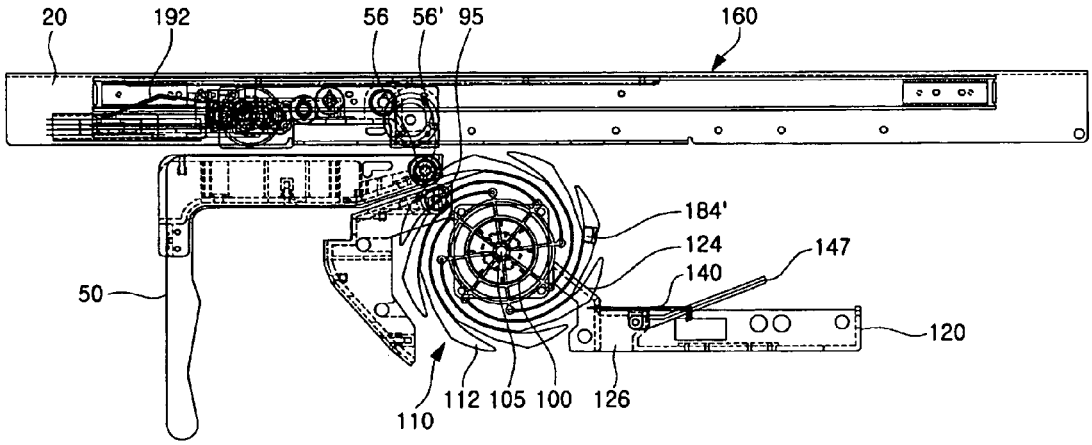

In a state where the shuttle members 146 incline toward the rear end of the stacking base 120, the clamp assembly 160 moves to the right side in the figure, and simultaneously, the clamp base 168 rotates clockwise. Such a process is shown in FIGS. 11*e* to 11*g*.

Next, the clamp assembly 160 is moved by the tray delivery motor 165. That is, the driving force of the tray delivery motor 165 is transferred to one of the rack interconnecting gears 166' through the motor gear 165', so that the delivery driving shaft 166 rotates. The rotation of the delivery driving shaft 166 causes the rack interconnecting gears 166', which are engaged with the racks provided in the clamp guide 20, respectively, to move, so that the clamp assembly 160 moves.

The clamp assembly 160 moves as above until the clamp assembly 160 is sensed by the leftmost one among the magnetic field sensors 164' in FIG. 3. At the position where the clamp assembly 160 is sensed by the magnetic field sensor 164', the media clamped by the clamp arm 184 and the clamp base 168 of the clamp assembly 160 are supported by the extension clamp 169 and prevented from sagging downward. In addition, the extension clamp 169 is caught to a portion of the clamp guide 20 and thus does not protrude out of the clamp guide 20, so that only the media protrude. That is, the extension clamp 169 is caught to the portion at a front end of the clamp guide 20 and thus relatively retracted along the clamp base 168. So to speak, the extension clamp 169 is relatively retracted along the guide shafts 170 while elastically deforming the elastic members 170'. Such a state is shown in FIG. 11*i*.

Furthermore, if the customer takes out the media, the clamp assembly 160 moves in the opposite direction. The movement of the clamp assembly 160 causes the extension clamp 169 to protrude to its initial position. The clamp assembly 160 is moved to its initial state by the driving force of the tray delivery motor 165. That is, the media dispenser gets ready for stacking media by request of the next customer. So to speak, the media dispenser becomes in the state shown in FIG. 11*a*. Here, the shuttle members 146 are moved to their initial state by the driving force of the driving motor 130.

Figure 11I:
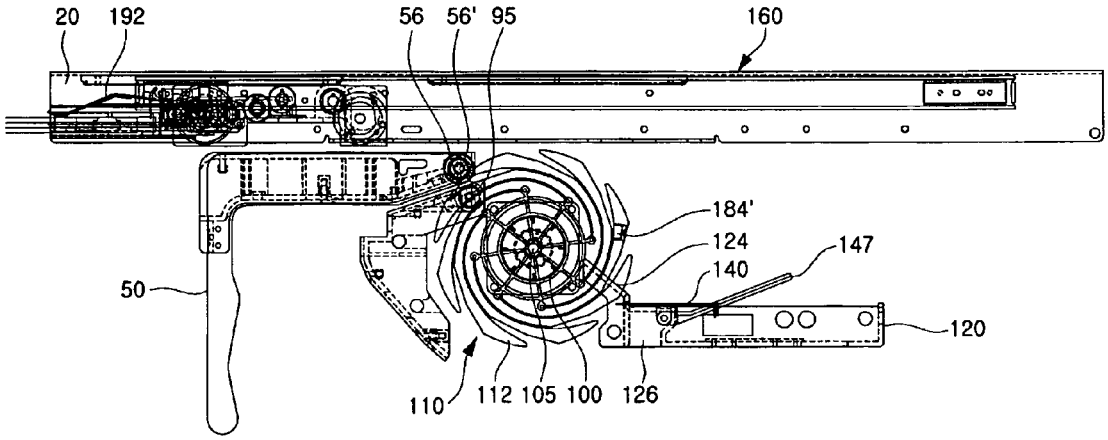

In the meantime, if the customer has not yet taken out the media at the state shown in FIG. 11*i*, the media should be rejected and fed to the reject box 4. Such a process is reversely performed in order from FIG. 11*i* to FIG. 11*d*.

In the state shown in FIG. 11*d*, the driving motor 130 causes the driving plate 138 to move in the direction of the driving motor 130. The shuttle member 147 rotates no more, and moves together with the driving plate 138 with the rotated angle of the shuttle member 147 maintained. Here, the interconnecting pieces 138*m* of the driving plate 138 and the interconnecting pieces 141 of the stacking plate 140 are caught to each other, so that the stacking plate 140 is moved by the driving plate 138.

The stacking plate 140 is guided by the guide rods 142 and then moves. Particularly, the stacking plate 140 moves while elastically deforming the restitution members 143. The driving plate 138 moves until the third sensing piece 157*c* of the driving plate 138 is sensed by the dump sensor 159. Such a state is shown in FIG. 12*c*.

In the meantime, the front end inclined portion 138' of the driving plate 138 pushes the locker 156. The locker 156 protrudes downward from the stacking base 120 and thus is caught into a groove formed on an upper surface of the reject box 4. In such a state, when the media are rejected, the reject box 4 cannot get out of the media dispenser. For example, even if power is not supplied in the state shown in FIG. 12*c*, since an outsider cannot get the reject box 4 out of the media dispenser, it is possible to prevent an unexpected theft.

Figure 12C:
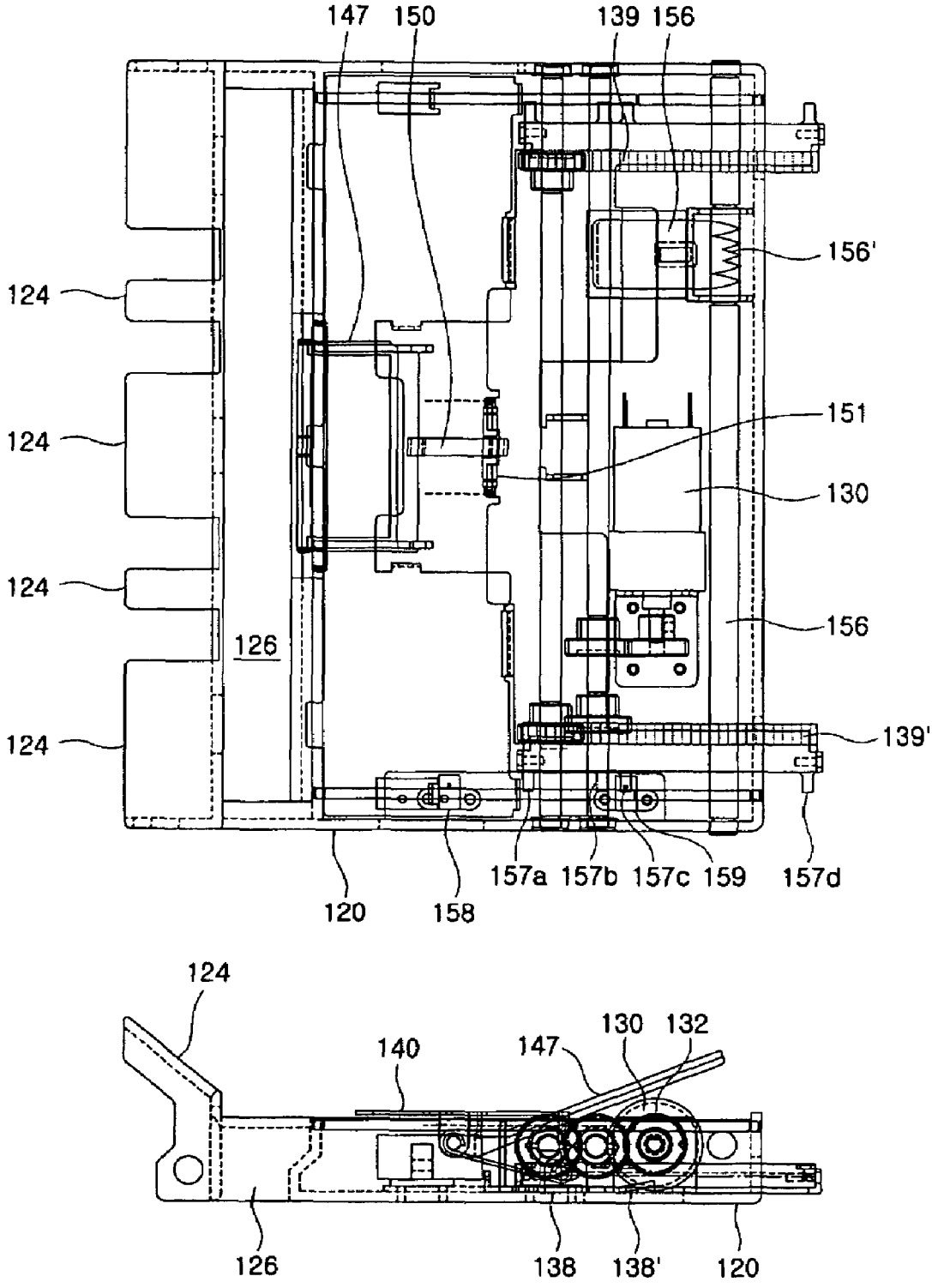

If the stacking plate 140 is in the state shown in FIG. 12*c*, the reject slot 126 is opened. Therefore, the media clamped by means of the clamp base 168 and the clamp arm 184 may be rejected into the reject box 4 through the reject slot 126. For reference, the reject box 4 is provided with an inlet for receiving the media rejected by the reject belt 85 and another inlet for receiving a bundle of the media on the clamp assembly 160.

If the clamp arm 184 is lifted at the state shown in FIG. 12*c*, the media clamped by means of the clamp base 168 and the clamp arm 184 are dropped into the reject box 4 through the reject slot 126. Here, the rotation of the stacking wheels 110 causes all of the media to enter the reject box 4.

If the media are completely rejected, in order to erect media on the stacking plate 140 by request of the next customer, the respective components move to their initial states shown in FIG. 11*a*. Here, if the interconnecting pieces 138*m* and 141 are caught to each other no more as the driving plate 138 is moved to its initial position, the stacking plate 140 is moved to its initial position by the elastic force of the restitution members 143.

In addition, the shuttle members 146 are installed such that the push bars 147 incline toward the stacking wheels 110 according to the positions of the stacking plate 140 and driving plate 138 and the positional relationships between the connecting link 150, the connecting shaft 148, and the elastic members 154.

According to the stacking module of the media dispenser of the present invention so constructed and the control method thereof, the following advantages can be expected.

First, in the present invention, since most of the components for stacking the media as many as the customer wants are provided on the stacking base, the media dispenser of the present invention is modularized. Therefore, there is an advantage in that it is possible to repair the stacking module by disassembling only the stacking base from the guide plates.

In addition, according to the present invention, it is possible to collect a customer's desired number of the media fed from the media box one by one and to deliver them at a time. Therefore, since the media can be delivered in a bundle when delivered to the customer, there is an advantage in that it is easy for the customer to take out the media.

Furthermore, according to the present invention, in the stacking module for stacking a number of the media, since the one driving motor drives the driving plate, the stacking plate, and the shuttle member, the number of the components is relatively reduced.

The scope of the present invention is not limited to the embodiment described and illustrated above but is defined by the appended claims. It will be apparent that those skilled in the art can make various modifications and changes thereto within the scope of the invention defined by the claims. Therefore, the true scope of the present invention should be defined by the technical spirit of the appended claims.

For example, the wheel rotating shaft 105 mounted with the driving motor 100 and the stacking wheels 110 may be installed at portions where both the ends of the stacking base 120 extend.

What is claimed is:

1. A stacking module of a media dispenser, comprising:

stacking wheels rotated by a driving source to rotate a media fed from a delivery module with the media inserted between tangent wings of outer peripheral surfaces of the stacking wheels one by one;

a separation plate for separating the media from the stacking wheels and guiding the separated media;

a stacking plate on which the media separated from the separation plate are erected one by one;

a shuttle member installed on the stacking plate rotatably in a circular motion such that the shuttle member is rotated in the circular motion toward a position substantially in a same plane as the stacking plate to allow a space to move the media above the stacking plate while the media is removed from the stacking plate, the shuttle member including a push bar that rotates in a circular motion with respect to an axis on the shuttle member so as to push via the circular rotation the media erected on the stacking plate toward the stacking wheels; and a driving plate moved by an additional driving source to selectively drive the stacking plate and the shuttle member.

2. The stacking module as claimed in claim 1, wherein the stacking wheels, the separation plate, the stacking plate, the shuttle member, and the driving plate are provided on a stacking base two ends of which are supported in guide plates installed to face each other with a predetermined spacing therebetween.

3. The stacking module as claimed in claim 1, wherein the stacking wheels and the driving source are provided between guide plates installed to face each other with a predetermined spacing therebetween; and the separation plate, the stacking plate, the shuffle member, and the driving plate are provided on a stacking base supported in the guide plates.

4. The stacking module as claimed in claim 3, wherein two side ends of the stacking plate are supported on guide rods which are positioned on the stacking base at a predetermined height and include a restitution member for causing the stacking plate to move toward the separation plate.

5. The stacking module as claimed in claim 1, wherein the separation plate is installed to downwardly incline to the stacking plate and to be perpendicular to a tangential direction of a rotating trace of the stacking wheels between the stacking wheels.

6. The stacking module as claimed in claim 1, wherein the stacking plate and the driving plate are provided with interconnecting pieces at corresponding positions thereof, respectively, wherein the interconnecting pieces substantially vertically protrude downward and upward respectively from the stacking plate and the driving plate and are selectively caught to each other.

7. The stacking module as claimed in claim 1, wherein a lower portion of the push bar of the shuttle member is connected to a connecting shaft, the driving plate is rotatably mounted with a link shaft, and both ends of a connecting link are rotatably connected to the connecting shaft and the link shaft, respectively, so that a movement of the driving plate causes the shuttle member to rotate.

8. The stacking module as claimed in claim 7, wherein the link shaft is movably seated in elongated holes of shaft supporting pieces formed in the driving plate, the link shaft is supported by an elastic member in order to move to one end of the elongated holes, and the link shaft moves in the elongated holes according to the number of the media provided between the shuttle member and the stacking wheels.

* * * * *